US010773260B2

(12) United States Patent
Walcutt

(10) Patent No.: US 10,773,260 B2
(45) Date of Patent: Sep. 15, 2020

(54) WASTE PROCESSING MACHINE SAFETY DEVICE

(71) Applicant: Bandit Industries, Inc., Remus, MI (US)

(72) Inventor: Timothy Ryan Walcutt, Remus, MI (US)

(73) Assignee: Bandit Industries, Inc., Remus, MI (US)

( * ) Notice: Subject to any disclaimer, the term of this patent is extended or adjusted under 35 U.S.C. 154(b) by 143 days.

(21) Appl. No.: 16/085,748

(22) PCT Filed: Mar. 17, 2017

(86) PCT No.: PCT/US2017/022935
§ 371 (c)(1),
(2) Date: Sep. 17, 2018

(87) PCT Pub. No.: WO2017/161246
PCT Pub. Date: Sep. 21, 2017

(65) Prior Publication Data

US 2019/0046990 A1 Feb. 14, 2019

Related U.S. Application Data

(60) Provisional application No. 62/309,585, filed on Mar. 17, 2016.

(51) Int. Cl.
*B02C 18/00* (2006.01)
*B02C 18/14* (2006.01)
(Continued)

(52) U.S. Cl.
CPC ..... *B02C 18/143* (2013.01); *B02C 18/06* (2013.01); *B02C 18/16* (2013.01); *B02C 18/18* (2013.01);
(Continued)

(58) Field of Classification Search
CPC ..... B02C 18/143; B02C 18/06; B02C 18/16; B02C 18/225; B02C 18/2283; B02C 18/04; B02C 18/18
(Continued)

(56) References Cited

U.S. PATENT DOCUMENTS 4,595,148 A 6/1986 Luerken et al.
5,509,453 A 4/1996 Crockett
(Continued)

FOREIGN PATENT DOCUMENTS

CA 2132942 A1 3/1996
EP 2338601 A2 6/2011

OTHER PUBLICATIONS

International Search Report and Written Opinion for PCT/US2017/022935; 7 pages.
(Continued)

*Primary Examiner* — Faye Francis
(74) *Attorney, Agent, or Firm* — Howard & Howard Attorneys PLLC

(57) ABSTRACT

A waste processing machine for reducing waste material and having a safety device for shearing lines. A housing defines a cutting chamber and an intake opening in communication with the cutting chamber for receiving waste material. A disc is disposed in the cutting chamber, rotates about an axis, and has an axial surface facing the intake opening. A cutting member is fixed to the disc for revolution about the axis concurrent with rotation of the disc for reducing waste material. A cutting anvil is coupled to the housing adjacent to the intake opening and faces the axial surface of the disc for reducing waste material between the cutting anvil and the cutting member. A line shear element is attached to the housing, extends into the cutting chamber toward the axial
(Continued)

surface of the disc, and is spaced from the cutting anvil for shearing lines caught by the rotating disc.

22 Claims, 23 Drawing Sheets

(51) Int. Cl.

| | |
|---|---|
| ***B02C 18/18*** | (2006.01) |
| ***B02C 21/02*** | (2006.01) |
| ***B02C 23/04*** | (2006.01) |
| ***B27L 11/02*** | (2006.01) |
| ***B27G 21/00*** | (2006.01) |
| ***B27L 11/00*** | (2006.01) |
| ***B02C 18/22*** | (2006.01) |
| ***B02C 18/16*** | (2006.01) |
| ***B02C 18/06*** | (2006.01) |

(52) U.S. Cl.
CPC ..... *B02C 18/2283* (2013.01); *B02C 21/02* (2013.01); *B02C 23/04* (2013.01); *B27G 21/00* (2013.01); *B27L 11/00* (2013.01); *B27L 11/002* (2013.01); *B27L 11/02* (2013.01); *B02C 2018/168* (2013.01); *B02C 2018/188* (2013.01)

(58) Field of Classification Search
USPC ..... 241/37.5, 92
See application file for complete search history.

(56) References Cited

U.S. PATENT DOCUMENTS

| | | | | |
|---|---|---|---|---|
| 5,547,136 | A | 8/1996 | Steffens et al. | |
| 5,683,042 | A | 11/1997 | Giovanardi | |
| 5,863,003 | A | 1/1999 | Smith | |
| 5,988,539 | A * | 11/1999 | Morey | B02C 18/14 241/34 |
| 6,000,642 | A | 12/1999 | Morey | |
| 6,032,707 | A | 3/2000 | Morey et al. | |
| 6,036,125 | A | 3/2000 | Morey et al. | |
| 6,047,912 | A | 4/2000 | Smith | |
| 6,059,210 | A | 5/2000 | Smith | |
| 6,138,932 | A | 10/2000 | Moore | |
| 6,299,082 | B1 | 10/2001 | Smith | |
| 6,357,684 | B1 | 3/2002 | Morey | |
| 6,517,020 | B1 | 2/2003 | Smith | |
| 6,722,596 | B1 | 4/2004 | Morey | |
| 6,814,320 | B1 | 11/2004 | Morey et al. | |
| 6,830,204 | B1 | 12/2004 | Morey | |
| 6,845,931 | B1 | 1/2005 | Smith | |
| 7,083,129 | B2 * | 8/2006 | Beam, III | A01G 3/002 241/37.5 |
| 7,121,485 | B2 | 10/2006 | Smith | |
| 7,163,166 | B1 | 1/2007 | Smith | |
| 7,384,011 | B1 | 6/2008 | Smith | |
| 7,513,449 | B2 | 4/2009 | Gross et al. | |
| 7,562,837 | B2 * | 7/2009 | Brand | A01G 3/002 241/101.2 |
| 7,669,621 | B2 | 3/2010 | Nettles et al. | |
| 7,726,594 | B2 | 6/2010 | Smith | |
| 9,233,375 | B2 * | 1/2016 | Kennedy | B02C 25/00 |
| 9,636,687 | B2 * | 5/2017 | Kennedy | B02C 25/00 |
| 9,981,405 | B2 * | 5/2018 | Kennedy | B27L 11/00 |
| 10,166,696 | B2 * | 1/2019 | Casper | B02C 18/16 |
| 10,589,290 | B2 * | 3/2020 | Walcutt | A01G 3/002 |
| 2003/0141394 | A1 | 7/2003 | Ueda et al. | |
| 2008/0296420 | A1 * | 12/2008 | Brand | A01G 3/002 241/34 |
| 2011/0111456 | A1 | 5/2011 | Medoff | |
| 2012/0043404 | A1 * | 2/2012 | Morey | B02C 25/00 241/25 |
| 2014/0138464 | A1 | 5/2014 | Casper | |

OTHER PUBLICATIONS

Marriott, Mark. Must See Video—Bandit Rope Shear Device. Press release (online). Queensland Arboricultural Association Inc. Feb. 18, 2016 (retrieved Jan. 7, 2019). <URL: https://www.facebook.com/queenslandarboriculturalassociation/posts/1046427662066525>.

Tree Care Machinery. New Winch Cable/Rope Shearing Device. Press release (online). Mar. 19, 2014 (retreived Jan. 7, 2019). <URL: http://treecaremach.com.au/ropr-shearing-device/>.

* cited by examiner

WASTE PROCESSING MACHINE SAFETY DEVICE

CROSS-REFERENCE TO RELATED APPLICATION

The subject patent application is the National Stage of International Patent Application No. PCT/US2017/022935, filed on Mar. 17, 2017, which claims priority to and all the benefits of U.S. Provisional Patent Application Ser. No. 62/309,585 which was filed on Mar. 17, 2016, the disclosures of which are hereby incorporated by reference.

BACKGROUND OF THE INVENTION

1. Field of the Invention

The present invention relates, generally, to waste processing machines and, more specifically, to a waste processing machine having a safety device for shearing lines.

2. Description of the Related Art

Conventional waste processing machines are employed to recycle, reduce, or otherwise process waste products or materials, such as bulk wood products, by chipping, cutting, grinding, or otherwise reducing the waste products. To this end, waste processing machines employ an infeed system to receive material to be reduced, such as wood products or tree limbs. A feed system with rotating feed wheels is employed to advance bulk material directed into the infeed system towards a cutting assembly. The cutting assembly, in turn, comprises a rotating disc or drum which is configured to reduce the bulk materials into chips. The chips are subsequently propelled out of a discharge chute arranged downstream of the cutting assembly.

In certain applications, one or more lines, cables, ropes, and the like may be used nearby or in connection with the waste processing machine. These lines, cables, or ropes are generally used to gather, secure, drag, lift, etc., the bulk products onto and into the infeed system for capture by the feed system (if provided) of the waste processing machine. By way of non-limiting example, a winch line may be used to drag heavy bulk materials towards the waste processing machine. Tree climber ropes or lines are also typically used nearby the waste processing machine.

Waste processing machines, and wood chippers in particular, are regularly utilized in a number of different industries. Those having ordinary skill in the art will appreciate that incorrect operation of waste processing machines can be potentially dangerous. Specifically, it will be appreciated that if proper procedures are not followed, it is possible for lines, cables, or ropes to be captured by one or more of the feed wheels of the feed system and/or by the disk or drum of the cutting assembly.

Once captured, the line, cable, or rope can become entangled with or captured by the rotating disc or drum and consequently may be retracted. This retraction of the line, cable, or rope may be too quick for an operator to react to and may cause safety issues. For example, retraction of the line, cable, or rope can cause the line, cable, or rope, and anything attached thereto, to be flung or whipped around, possibly causing damage or injury to nearby objects or operators. Further, if anything becomes entangled in the cable, line, or rope, it may be pulled towards the waste processing machine.

Accordingly, while conventional waste processing machines have generally performed well for their intended use, there remains a need in the art for waste processing machines which are, among other things, relatively inexpensive to manufacture and operate, and which provide for increased safety and reliability when used in connection with lines, cables, or ropes.

SUMMARY OF THE INVENTION

The present invention overcomes the disadvantages in the prior art in a waste processing machine for reducing waste material and having a safety device for shearing lines. The waste processing machine includes a housing defining a cutting chamber and an intake opening in communication with the cutting chamber for receiving waste material. A disc is disposed in the cutting chamber and is supported for rotation about an axis. The disc has an axial surface facing the intake opening. A cutting member is fixed to the disc for revolution about the axis concurrent with rotation of the disc for reducing waste material. A cutting anvil is coupled to the housing adjacent to the intake opening and is arranged facing the axial surface of the disc for reducing waste material between the cutting anvil and the cutting member as the cutting member revolves about the axis toward the cutting anvil. A line shear element is operatively attached to the housing, extends into the cutting chamber toward the axial surface of the disc, and is spaced from the cutting anvil for shearing lines caught by the rotating disc.

In this way, the waste processing machine safety device of the present invention affords opportunities for improved safety by promoting cutting, shearing, or otherwise breaking of lines, cables, and/or ropes inadvertently captured by the rotating disc that might otherwise pull objects towards the waste processing machine.

BRIEF DESCRIPTION OF THE DRAWINGS

Advantages of the present invention will be readily appreciated as the same becomes better understood after reading the subsequent description taken in connection with the accompanying drawings.

DETAILED DESCRIPTION OF THE INVENTION

Figure 1:
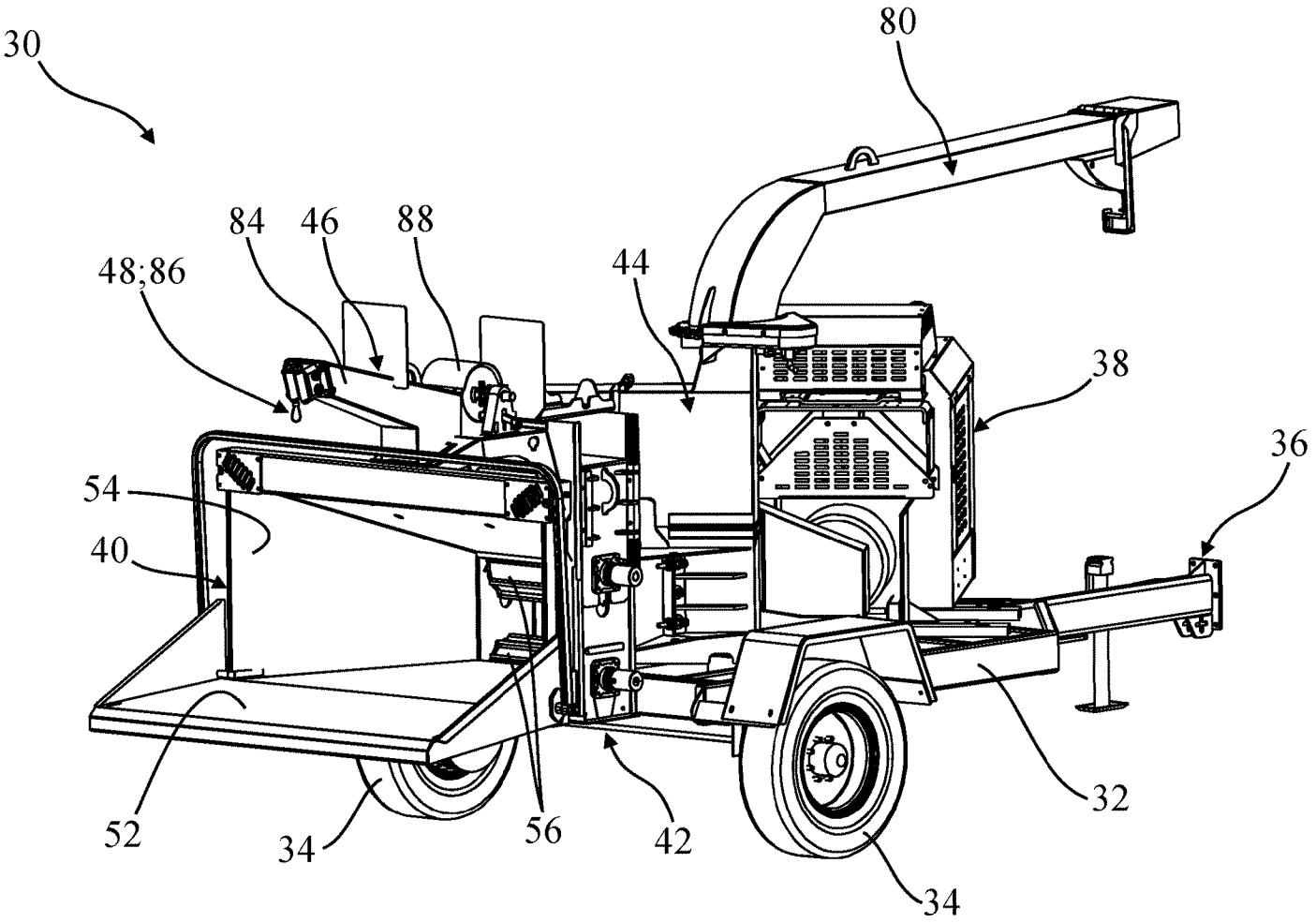
FIG. 1 is a perspective view of a waste processing machine shown having an infeed system, a feed system, and a cutting assembly with a safety device according to one embodiment of the present invention.

With reference to the Figures, where like numerals are used to designate like structure throughout the several views, a waste processing machine according to one embodiment of the present invention is depicted at 30 in FIG. 1. The waste processing machine 30 recycles, reduces, or otherwise processes products, such as bulk wood products, by chipping, cutting, grinding, or otherwise reducing the waste products. In the representative embodiment illustrated herein, the waste processing machine 30 is realized as a wood chipper. However, those having ordinary skill in the art will appreciate that the waste processing machine 30 could be of any suitable type or configuration sufficient to chip, grind, cut, or otherwise reduce bulk products or materials, without departing from the scope of the present invention.

Conventional waste processing machines 30, and wood chippers in particular, are regularly utilized in various industries. Those having ordinary skill in the art will appreciate that incorrect operation of waste processing machines 30 can be potentially dangerous. Accordingly, while conventional waste processing machines 30 have generally performed well for their intended use, there remains a need in the art for waste processing machines 30 which are, among other things, relatively inexpensive to manufacture and operate, and which provide for increased safety and reliability.

As noted above, the waste processing machine 30 depicted in FIG. 1 is realized as a mobile, disc-style wood chipper with a frame 32 supported by a pair of wheels 34. A conventional trailer hitch 36 operatively attached to the frame 32 allows the waste processing machine 30 to be towed by a vehicle (not shown). The frame 32 generally supports a power source 38, an infeed system 40, a feed system 42, a cutting assembly 44, a winch assembly 46 with a line 48, and a safety device 50. Each of these components, systems, and assemblies will be described in greater detail below.

Figure 2:
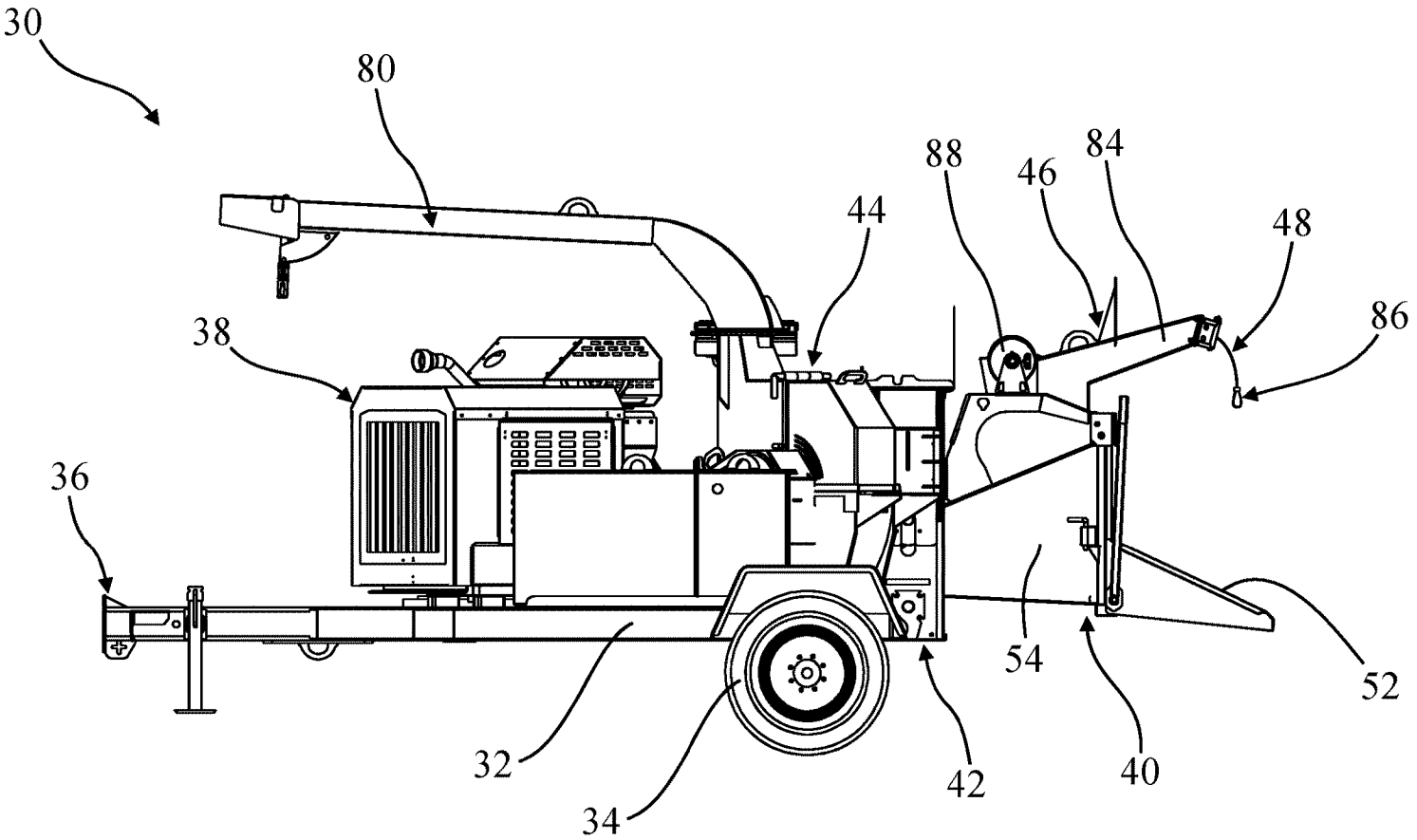
FIG. 2 is a left-side plan view of the waste processing machine of FIG. 1.
Figure 3:
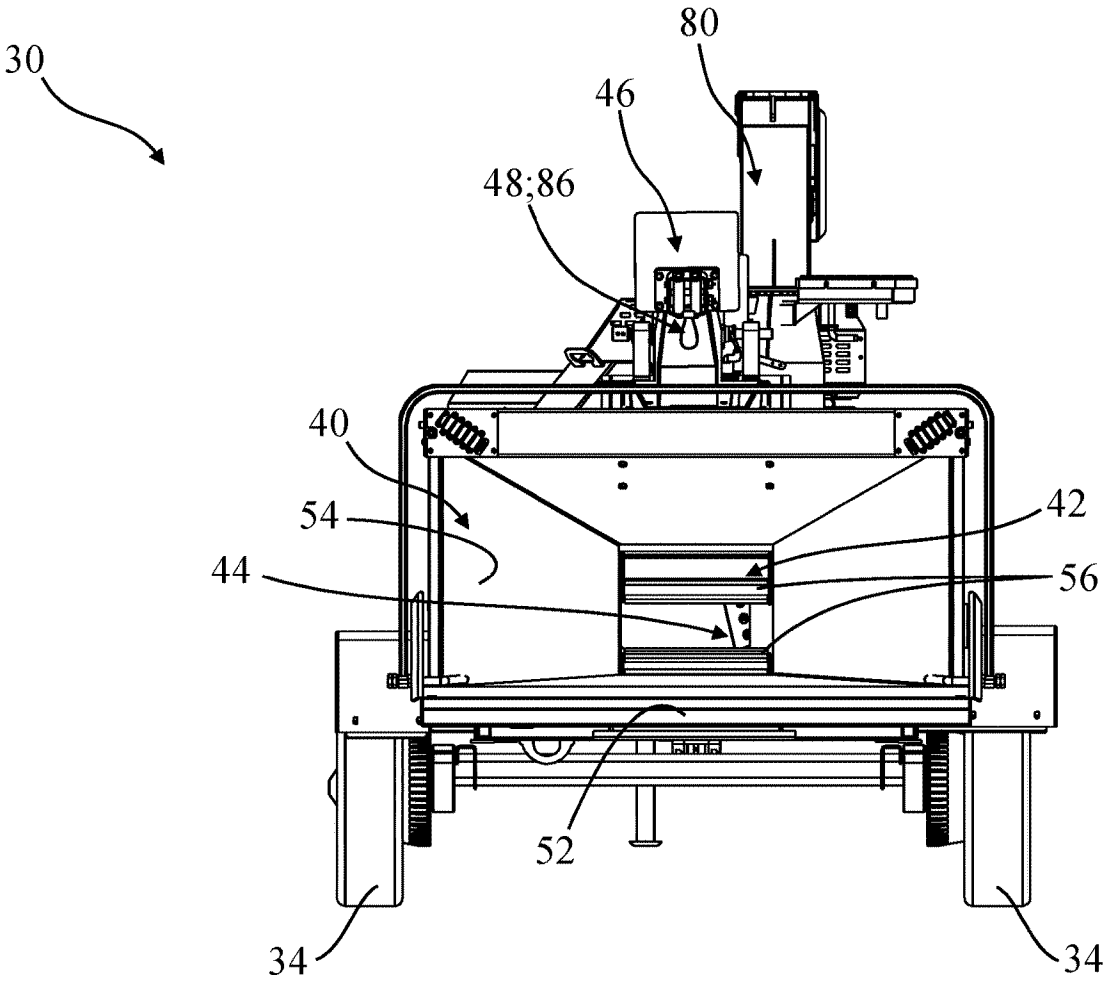
FIG. 3 is a front-side plan view of the waste processing machine of FIGS. 1-2.

As noted above, the waste processing machine 30 depicted in FIGS. 1-3 is configured so as to be transportable, such as by a vehicle. However, those having ordinary skill in the art will appreciate that the waste processing machine 30 could be configured in a number of different ways without departing from the scope of the present invention. By way of non-limiting example, the waste processing machine 30 could be stationary, could be implemented onto a vehicle, or could be supported on or otherwise moveable along a track.

The power source 38 is configured to provide a source of rotational torque which is used to drive the feed system 42 and the cutting assembly 44. To this end, the power source 38 may be realized as one or more internal combustion engines configured to translate rotational torque to certain components or systems of the waste processing machine 30, such as to the cutting assembly 44 and also to a hydraulic pump assembly which, in turn, may be used to drive components or systems (not shown). It will be appreciated that the power source 38 could be arranged or otherwise configured in any suitable way without departing from the scope of the present invention. By way of non-limiting example, the power source 38 could utilize or otherwise be realized by one or more electric motors, engines, generators, pump assemblies, hydraulic drives, and the like.

The infeed system 40 is employed to facilitate directing material, such as wood products or tree limbs, to the feed system 42 which, in turn, directs the material to the cutting assembly 44 to reduce the material. To this end, the infeed system 40 includes an infeed tray 52 and an infeed hopper 54 arranged to direct material into the feed system 42. Certain materials, such as relatively small branches or tree limbs, can be inserted directly into the infeed hopper 54 towards the feed system 42. Other materials, such as relatively larger branches or tree limbs, can be supported first on the infeed tray 52 and then inserted into the infeed hopper 54 towards the feed system 42. As described in greater detail below, the winch assembly 46 is used to pull particularly large or heavy materials onto the infeed tray 52 and into the infeed hopper 54 under certain operating conditions.

The feed system 42 is interposed between the infeed system 40 and the cutting assembly 44 and employs one or more feed wheels 56 (see FIGS. 1 and 3) arranged to pull materials inserted into the infeed hopper 54 towards the cutting assembly 44 to reduce the materials. However, as will be appreciated from the subsequent description below, the waste processing machine 30 could be configured without a feed system 42 for certain applications, whereby the infeed system 40 could be arranged in direct communication with the cutting assembly 44.

Referring now to FIGS. 1-10, as noted above, the cutting assembly 44 is arranged in communication with the feed system 42 and reduces waste material directed towards the cutting assembly 44 from the infeed system 40 via the feed system 42 (see FIG. 2). To this end, the cutting assembly includes a housing 58, a disc 60, a cutting member 62, and a cutting anvil 64. Each of these components will be described in greater detail below.

Figure 4:
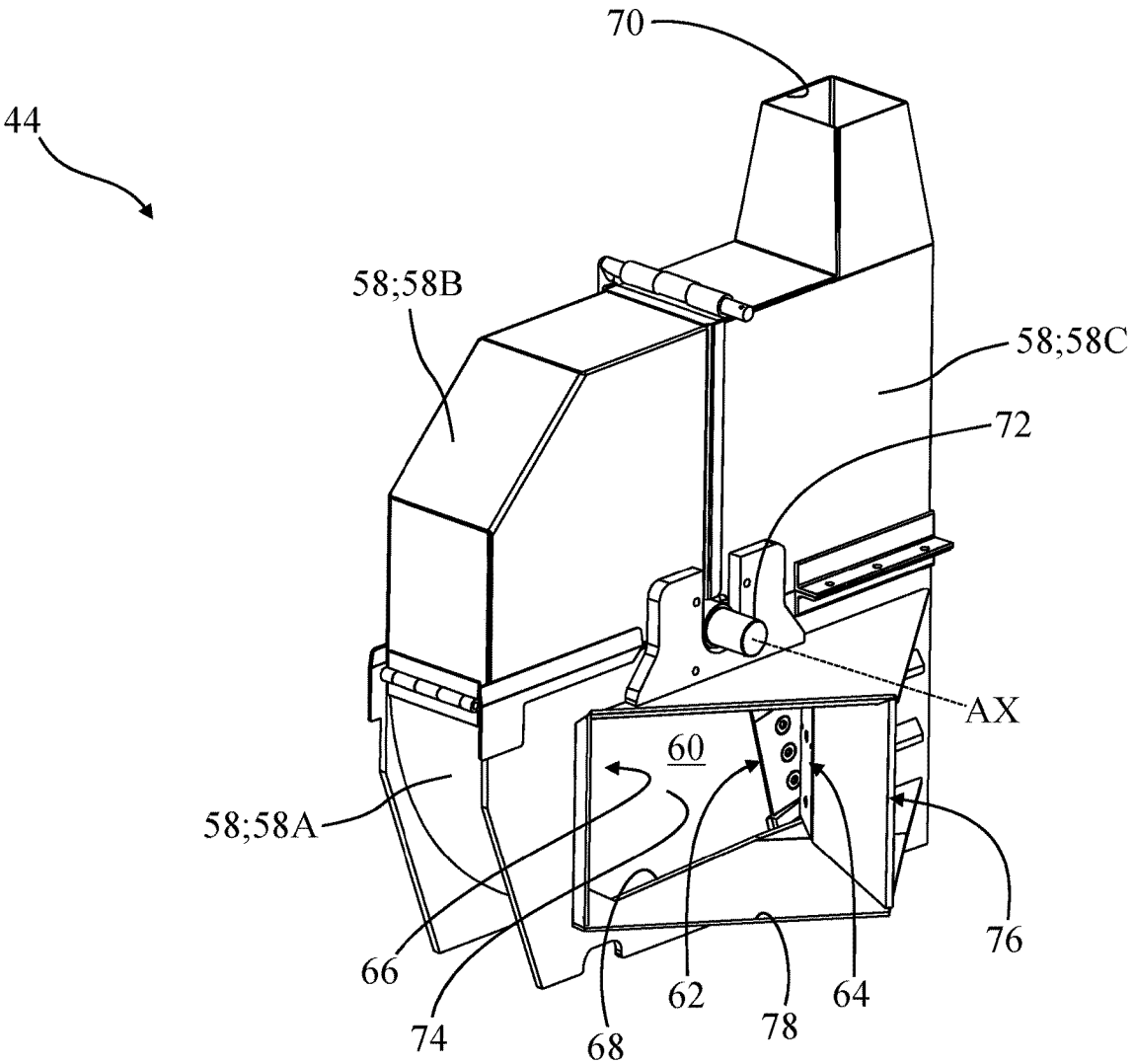
FIG. 4 is a partial perspective view of the cutting assembly of FIGS. 1-3, depicting a housing defining a cutting chamber and an intake opening, a disc with cutting members, and a cutting anvil coupled to the housing.
Figure 5:
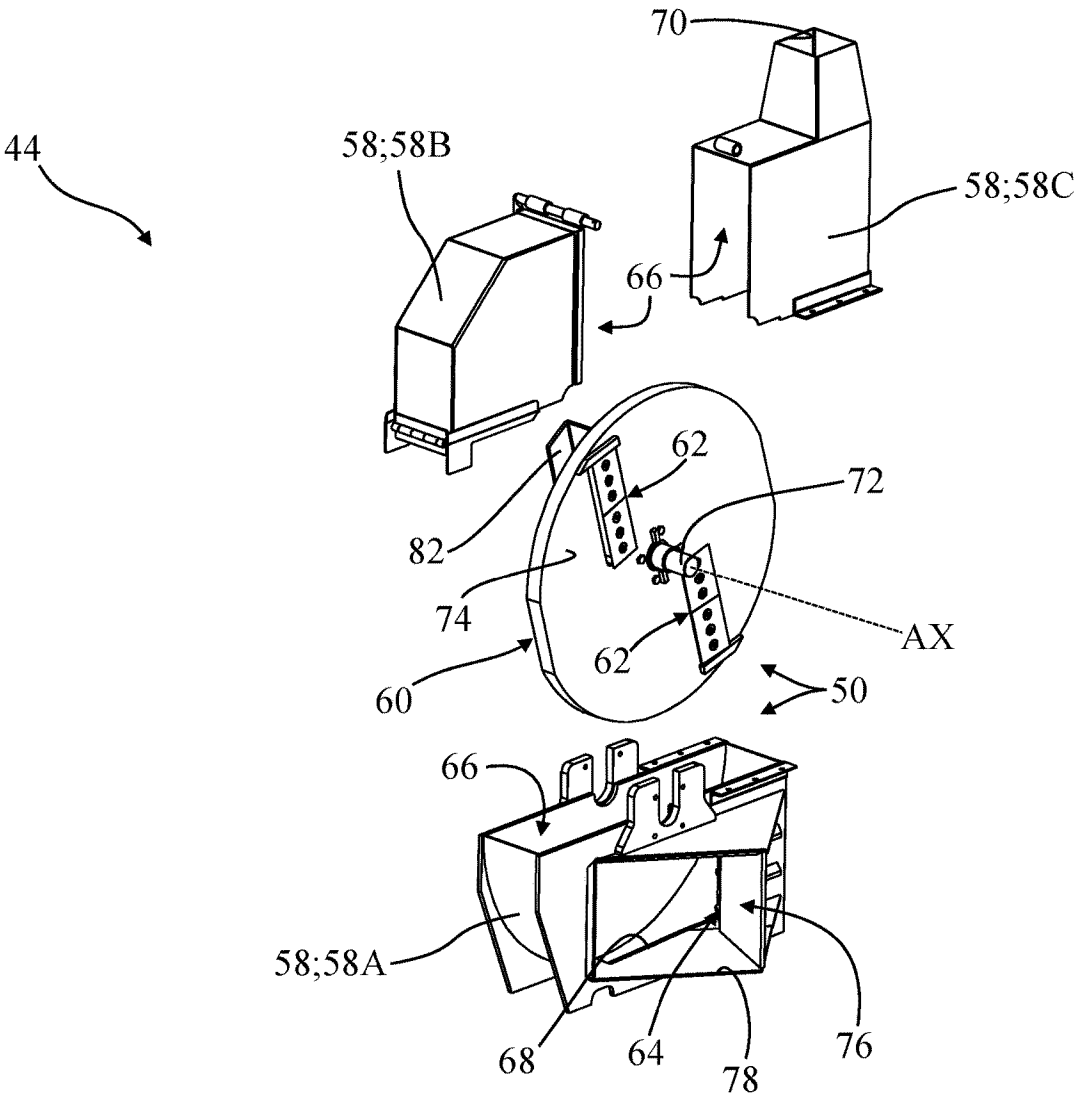
FIG. 5 is a front-side perspective view of the cutting assembly of FIG. 4, depicting a lower housing component spaced from a pair of upper housing components and the disc.
Figure 6:
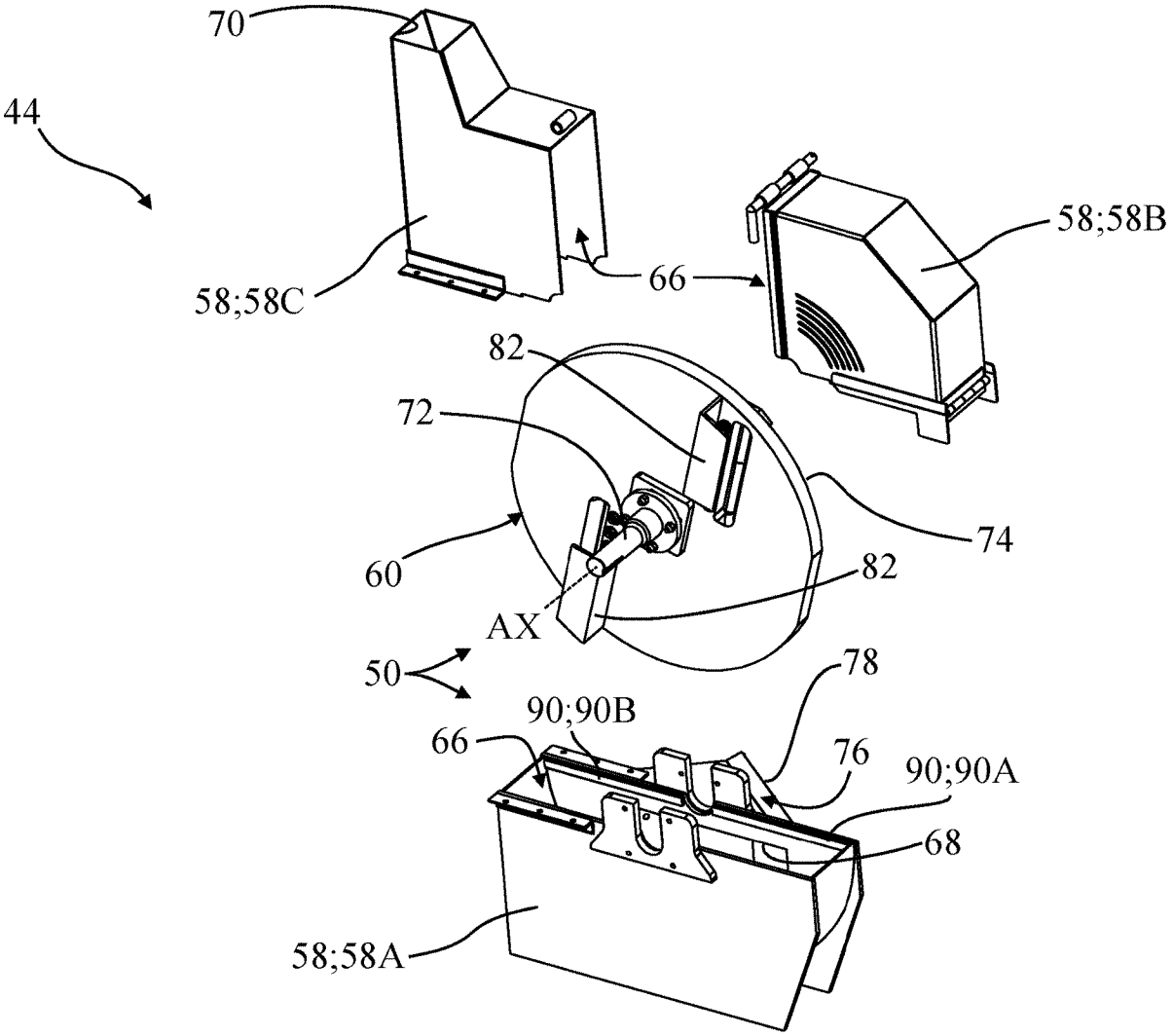
FIG. 6 is a front-side exploded perspective view of the cutting assembly of FIGS. 4-5.

As is best shown in FIGS. 4-6, the housing 58 of the cutting assembly 44 defines a cutting chamber 66, an intake opening 68 in communication with the cutting chamber 66 for receiving waste material, and a discharge opening 70 in communication with the cutting chamber 66 for expelling reduced waste material, as described in greater detail below. The disc 60 is disposed in the cutting chamber 66 and is supported for rotation about a shaft, generally indicated at 72, along an axis AX. The disc 60 has an axial surface 74 which faces the intake opening 68 defined in the housing 58. The cutting member 66 is fixed to the disc 60 for revolution about the axis AX concurrent with rotation of the disc 60 for reducing waste material. To this end, the cutting anvil 64 is coupled to the housing 58 adjacent to the intake opening 68 (see FIG. 7) and is arranged facing the axial surface 74 of the disc 60 for reducing waste material between the cutting anvil 64 and the cutting member 62 as the cutting member 62 revolves about the axis AX towards the cutting anvil 64. The axis AX is depicted by a dash-dash line in FIGS. 4-6 and 9, and is depicted as a centerline cross, without a leader or label for the purpose of clarity, in FIGS. 8 and 11A-17.

Those having ordinary skill in the art will appreciate that the cutting assembly 44 described and illustrated herein forms what is sometimes referred to in the related art as a "disc chipper" style waste processing machine 30. In the representative embodiment illustrated in FIGS. 1-10, and as is shown best in FIG. 9, the disc 60 is provided with a first cutting member 62A and with a second cutting member 62B spaced from the first cutting member 62A about the axial surface 74 of the disc 60. Here, each cutting member 62A, 62B is arranged so as to revolve around the axis AX as the disc 60 rotates, and to reduce material passing between the respective, moving cutting member 62A, 62B and the stationary cutting anvil 64. In the representative embodiment illustrated herein, the cutting assembly 44 is arranged at an angle relative to the front of the waste processing machine 30, with a funnel 76 extending from the intake opening 68 toward the feed system 42 to a funnel inlet 78, which is generally rectangular and faces the infeed hopper 54. Other configurations are contemplated herein, such as a disc 60 which is arranged with the axial surface 74 substantially parallel to the infeed system 40. Moreover, those having ordinary skill in the art will appreciate that the specific configuration, arrangement, size, shape, and the like of the disc 60, the cutting members 62A, 62B, the cutting anvil 64, and the housing 58 can be adjusted without departing from the scope of the present invention.

As noted above, the cutting assembly 44 is driven by the power source 38 which may be throttled or otherwise controlled so as to drive the disc 60 of the cutting assembly 44 at a predetermined rotational speed. Here, a clutch, transmission, and/or geartrain may be interposed between the power source 38 and the cutting assembly 44 to modulate or interrupt torque translation therebetween (not shown, but generally known in the art). The feed system 42 is likewise driven by the power source 38 and is generally controlled independently of the cutting assembly 44 using hydraulics (not shown, but generally known in the art). The disc 60 of the cutting assembly 44 generally rotates at a relatively high velocity, and the feed wheels 56 of the feed system 42 generally rotate relatively slowly. In operation, material directed into the infeed system 40 is captured between the opposed, rotating feed wheels 56 of the feed system 42 which direct, pull, or otherwise cause the materials to move towards the cutting assembly 44 where they encounter the revolving cutting members 62 on the axial surface 74 of the disc 60 of the cutting assembly 44, and the cutting anvil 64 arranged in the intake opening 68 of the housing 58, and are reduced into chips which are expelled out of the discharge opening 70 towards a discharge chute 80. As shown in FIG. 6, one or more windage elements 82 may be fixed to the disc 60 to help urge chips towards the discharge opening 70 as the disc 60 rotates about the axis AX in operation.

Referring now to FIGS. 4-8, as noted above, the housing 58 defines the cutting chamber 66, the intake opening 68, and the discharge opening 70. As is best shown in FIGS. 5 and 6, in one embodiment, the housing 58 includes a lower housing portion 58A, a first upper housing portion 58B, and a second upper housing portion 58C. Here, the intake opening 68 is formed in the lower housing portion 58A, and the discharge opening 70 is formed in the second upper housing portion 58C. However, those having ordinary skill in the art will appreciate that the housing 58 could be formed from or otherwise be defined by any suitable number of components without departing from the scope of the present invention.

As noted above, the winch assembly 46 cooperates with the infeed system 40 to direct materials towards the feed system 42. To this end, the winch assembly 46 includes a boom 84 through which the line 48 extends to a line end 86. The line 48 is tensioned using a winch driver, generally indicated at 88. The winch driver 88 is configured to pull the line end 86 towards the boom 84 and the winch driver 88 and allow the line end 86 to be selectively moved away from the winch driver 88. Here, the line 48 (also referred to herein as a "cable," "rope," or "winch line") is generally used to gather, secure, drag, lift, etc., large or bulky materials onto the infeed tray 52 and into the infeed system 40 for capture by the feed system 42. As the winch assembly 46 is utilized, if proper procedures are not followed, it is possible for the line end 86 or another portion of the line 48 to be captured by one or more of the feed wheels 56 of the feed system 42 and/or disc 60 of the cutting assembly 44, whereby the line 48 could become quickly entangled with or captured by the rotating disc 60 of the cutting assembly 44 and consequently retracted into the cutting assembly 44. As such, retraction of the line 48 may be too quick for an operator to react to and may cause safety issues. For example, rapid retraction of the line 48 may cause the line end 86, and anything attached thereto, to be uncontrollably flung or whipped around, possibly causing damage or injury to nearby objects or operators. Further, anything encompassed by the line 48 could be pulled quickly towards the waste processing machine 30 if the line end 86 and/or a portion of the line 48 were to be captured by the disc 60. Similarly, anything entangled with the line 48 during such a sudden retraction may be rapidly pulled towards the waste processing machine 30.

While the line 48 is described herein as forming part of the winch assembly 46, those having ordinary skill in the art will appreciate that other types of lines 48, cables, winch lines, ropes, and the like are frequently used in connection with or nearby waste processing machines 30 (for example, tree-climber ropes), and present similar safety concerns. As such, in the following description, the line 48 and the line end 86 could be of any type or configuration and could form a part of the waste processing machine 30 itself, or could form part of a separate component, system, and the like.

As noted above, the cutting members 62 and the cutting anvil 64 are arranged so as to reduce material passing into the intake opening 68 as the disc 60 rotates in operation. Here, the cutting anvil 64 is set to a predetermined position relative to the cutting members 62, and may be adjustable so as to compensate for wear, to adjust chip size, and the like. While the spacing between the cutting anvil 64 and the cutting members 62 is typically much smaller than the thickness, diameter, and/or size of the line 48, it is still sometimes possible for a line 48 to become trapped by the rotating disc 60 and become retracted/wound into the cutting chamber 66 without passing between the cutting anvil 64 and the cutting member 62. Moreover, rotation of the disc 60 tends to pull a trapped line 48 radially inwardly, such as towards the shaft 72. Here, in certain applications, the relative shape and orientation of the cutting members 62 and the cutting anvil 64 may allow a significant length of trapped line 48 to retract inwardly towards the shaft 72 before passing between the cutting anvil 64 and the cutting member 62. Nevertheless, because of the speed at which the disc 60 rotates during operation, a single revolution of the disc 60 could potentially result in a length of the line 48 (for example, several feet) being retracted quickly into the cutting chamber 66.

Referring now to FIGS. 7-13, the safety device 50 of the present invention is implemented in order to promote safe operation of the waste processing machine 30 and to help prevent damage or injury caused by retraction of the line 48, as noted above, by shearing lines 84 which may become trapped by the rotating disc 60. To this end, in one embodiment, the safety device 50 includes a line shear element, generally indicated at 90, which is operatively attached to the housing 58, extends into the cutting chamber 66 towards the axial surface 74 of the disc 60, and is spaced from the cutting anvil 64 for shearing lines 84 caught by the rotating disc 60. Unlike the cutting anvil 64 disposed in the intake opening 68, the line shear element 90 is not configured, positioned, or arranged so as to reduce waste materials. Rather, the line shear element 90 is provided to shear, cut, or otherwise break the trapped line 48 as the disc 60 rotates, as noted above.

Figure 11E:
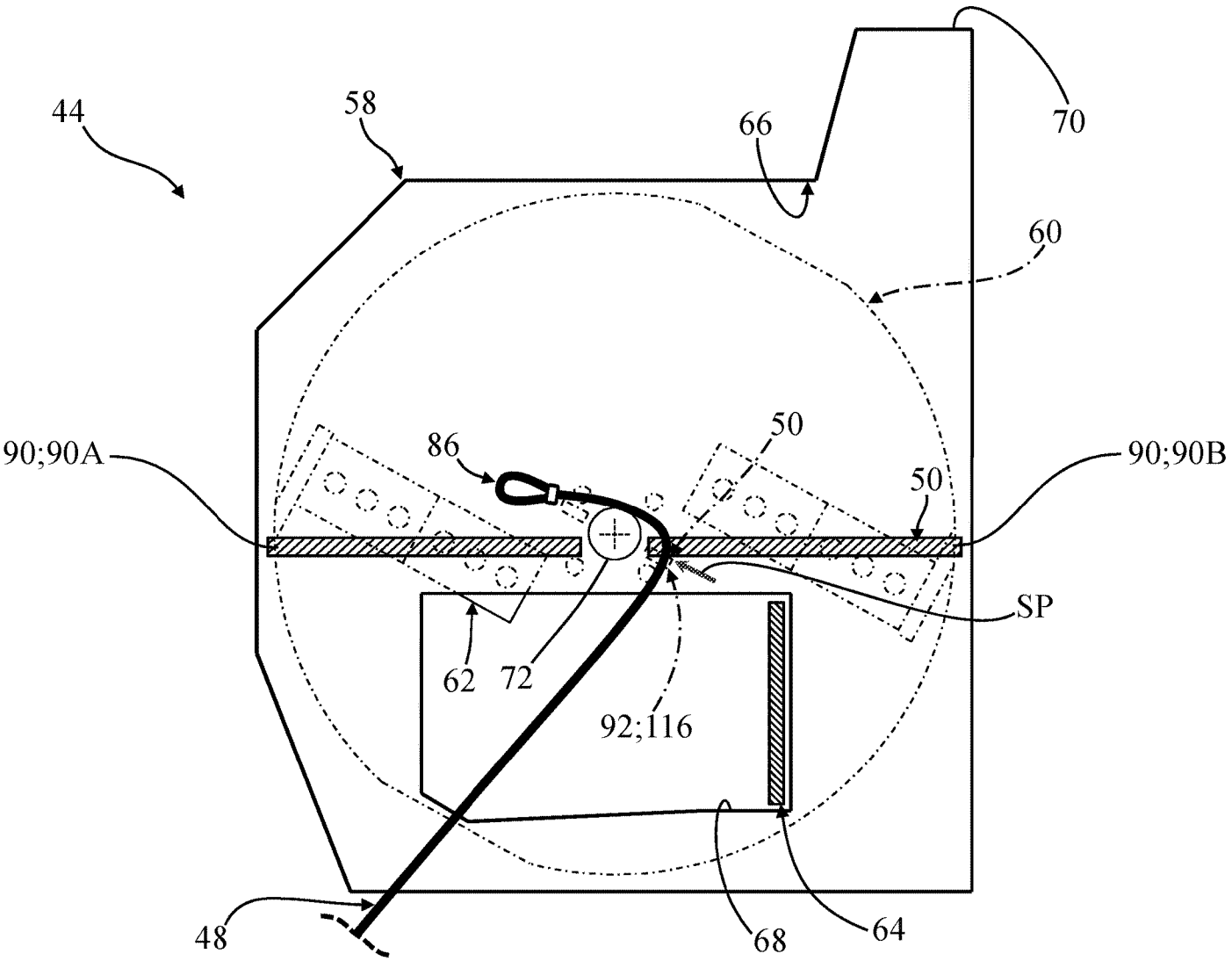
FIG. 11E is a fifth, consecutive front-side schematic illustration of the disc, the housing, the line, and the line end of FIGS. 11A-11D, showing the line end pulled even further into the cutting chamber by the rotating disc, with a portion of the line positioned to be cut between one of the line shear elements and one of the inner shear blocks.
Figure 12:
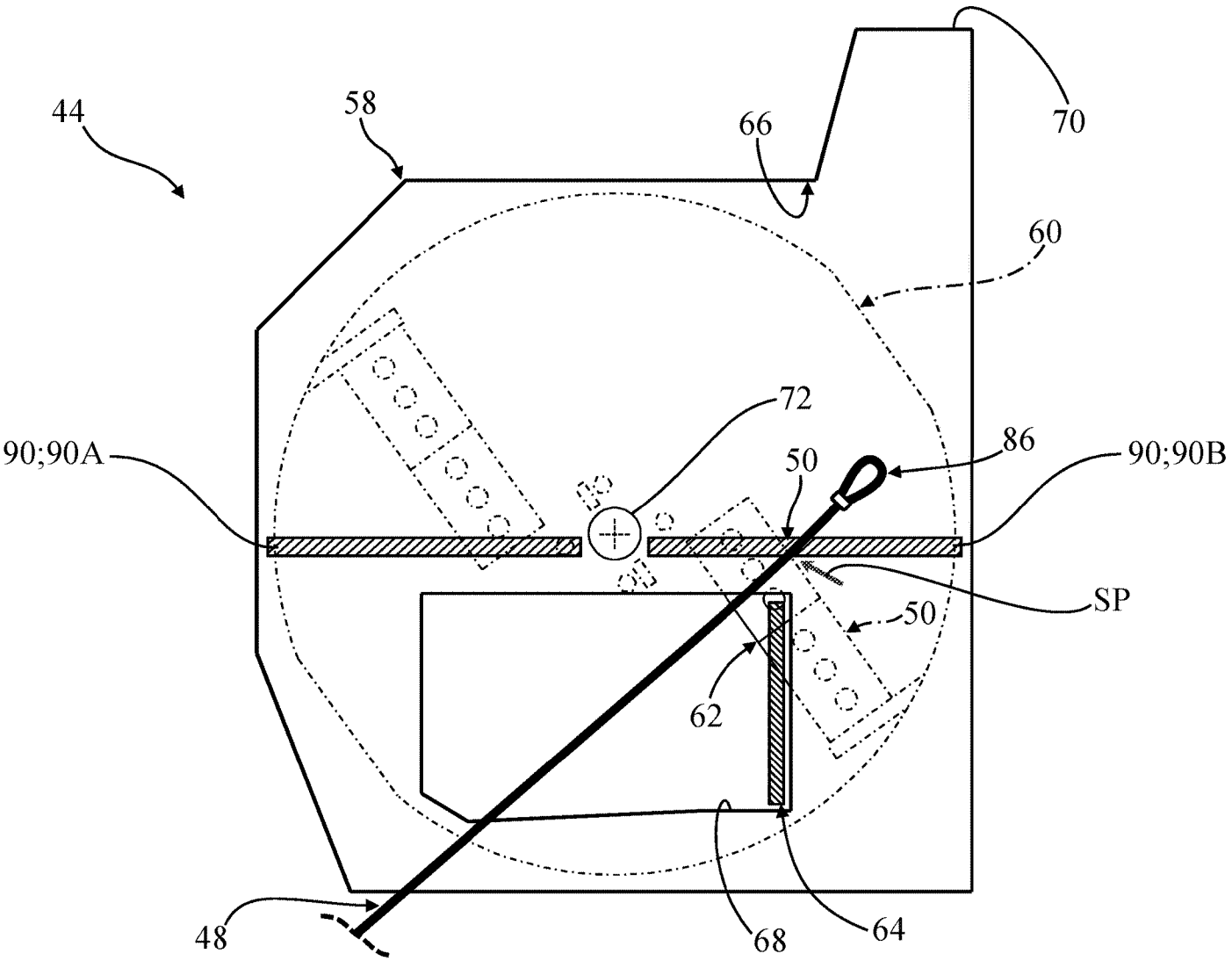
FIG. 12 is another schematic illustration of the disc, the housing, the line, and the line end of FIG. 11A, showing the line end pulled into the cutting chamber by the rotating disc, with a portion of the line positioned to be cut between one of the line shear elements and one of the cutting members.
Figure 13:
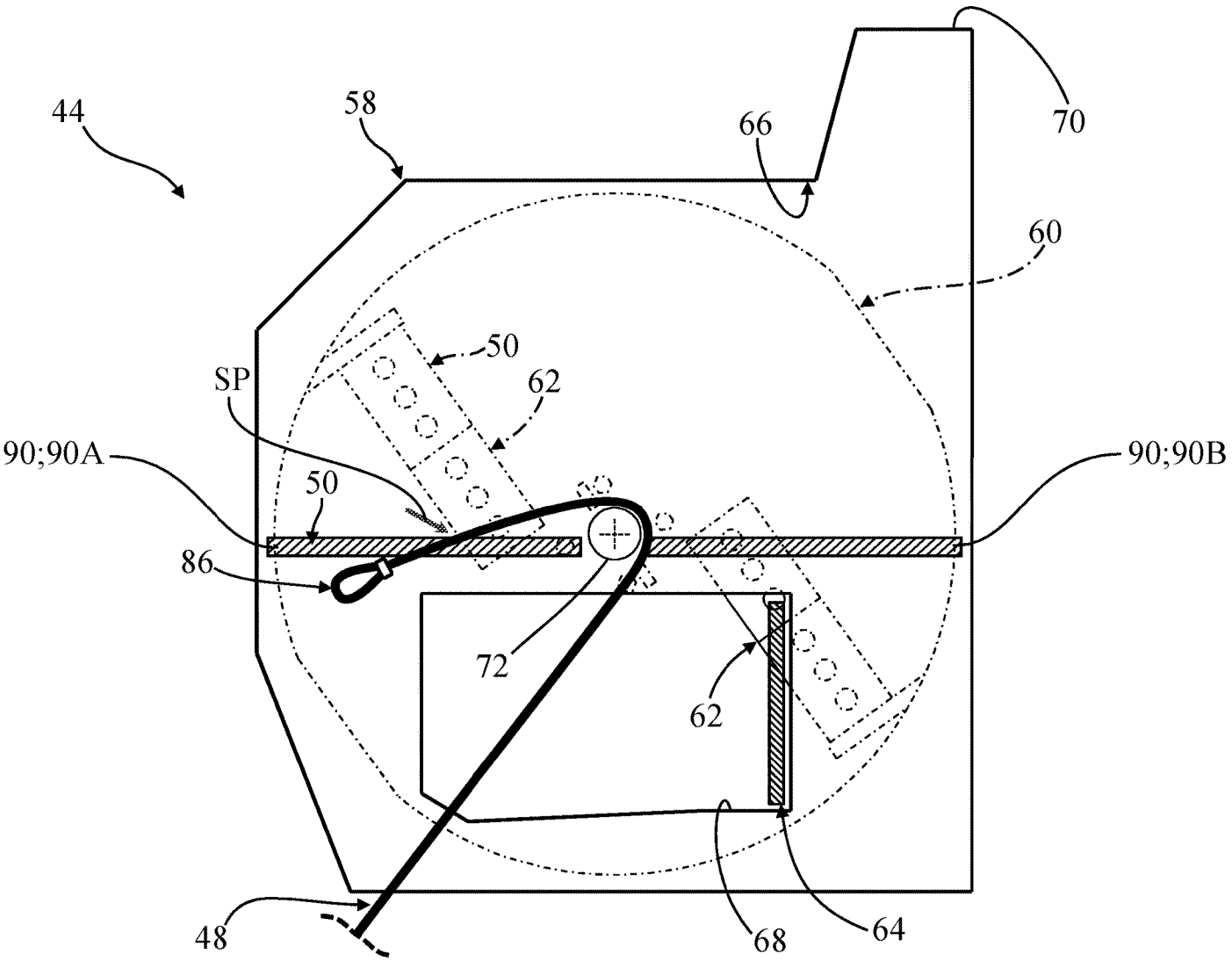
FIG. 13 is another schematic illustration of the disc, the housing, the line, and the line end of FIG. 12, showing the line end pulled into the cutting chamber by the rotating disc, with a portion of the line positioned to be cut between another of the line shear elements and one of the cutting members.
Figure 14:
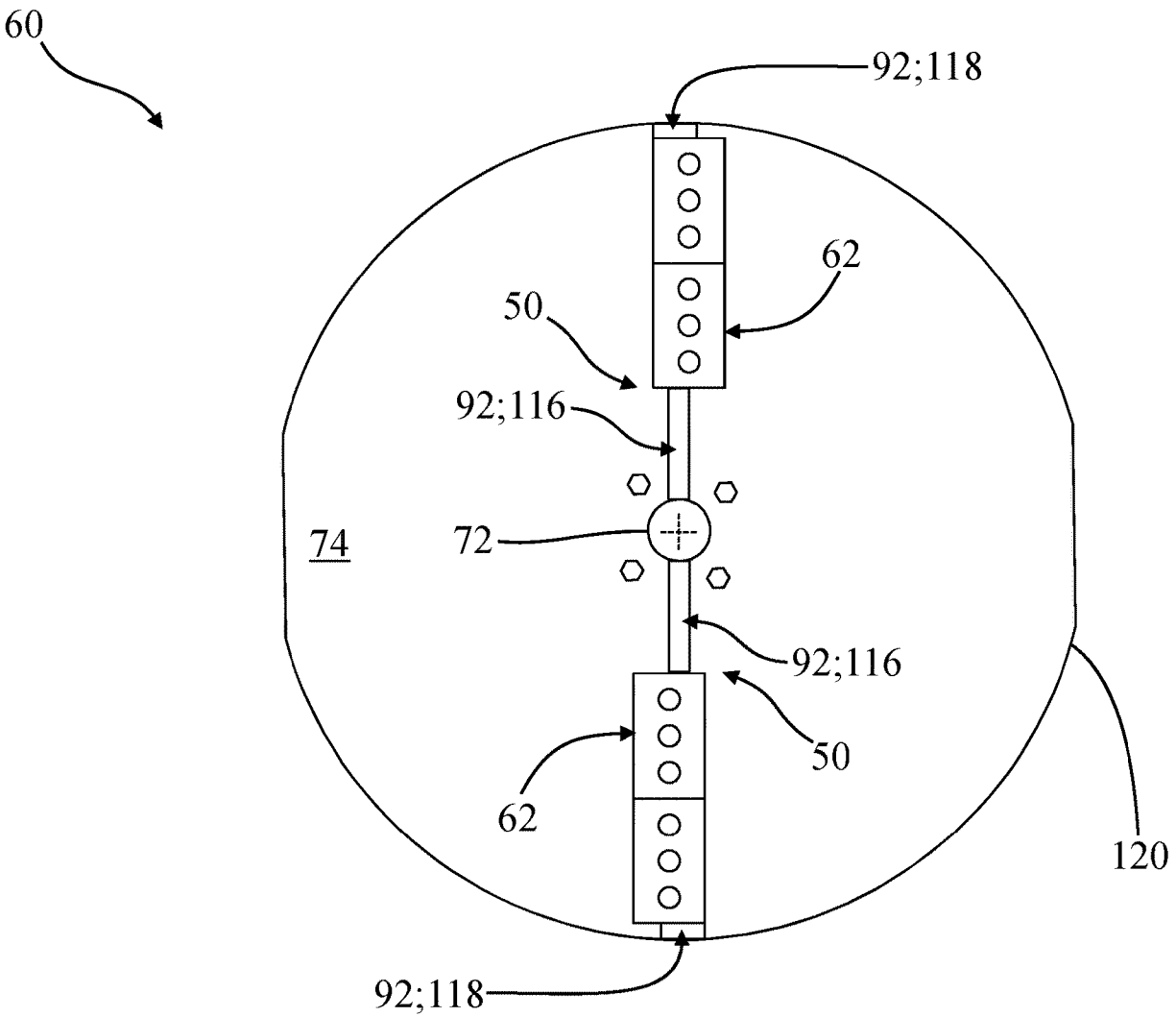
FIG. 14 is a front-side schematic illustration depicting another embodiment of a disc for use with the cutting assembly of FIGS. 4-6, shown having cutting members, inner shear blocks, and outer shear blocks.
Figure 15:
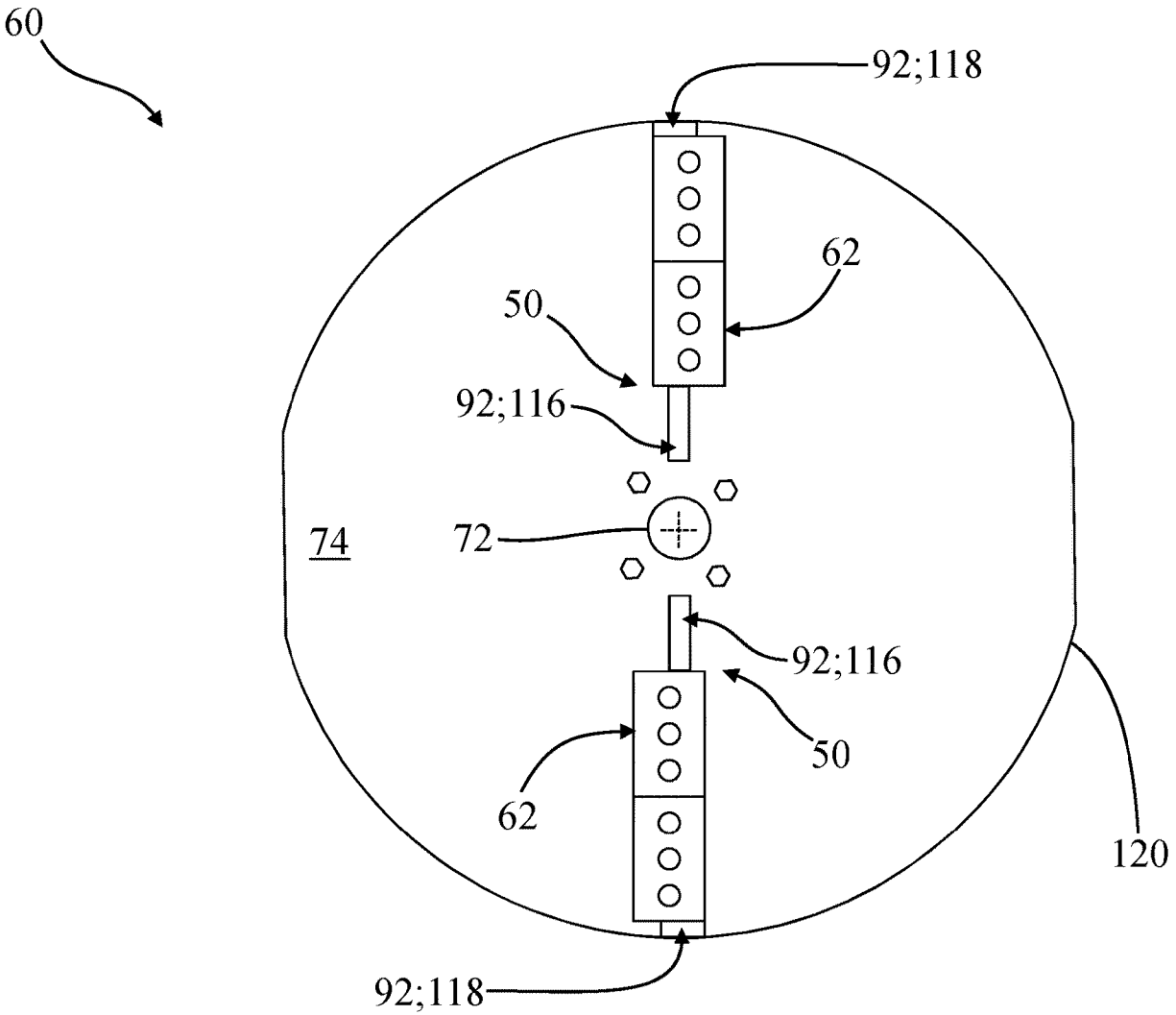
FIG. 15 is a front-side schematic illustration depicting another embodiment of a disc for use with the cutting assembly of FIGS. 4-6, shown having cutting members, inner shear blocks, and outer shear blocks.
Figure 16:
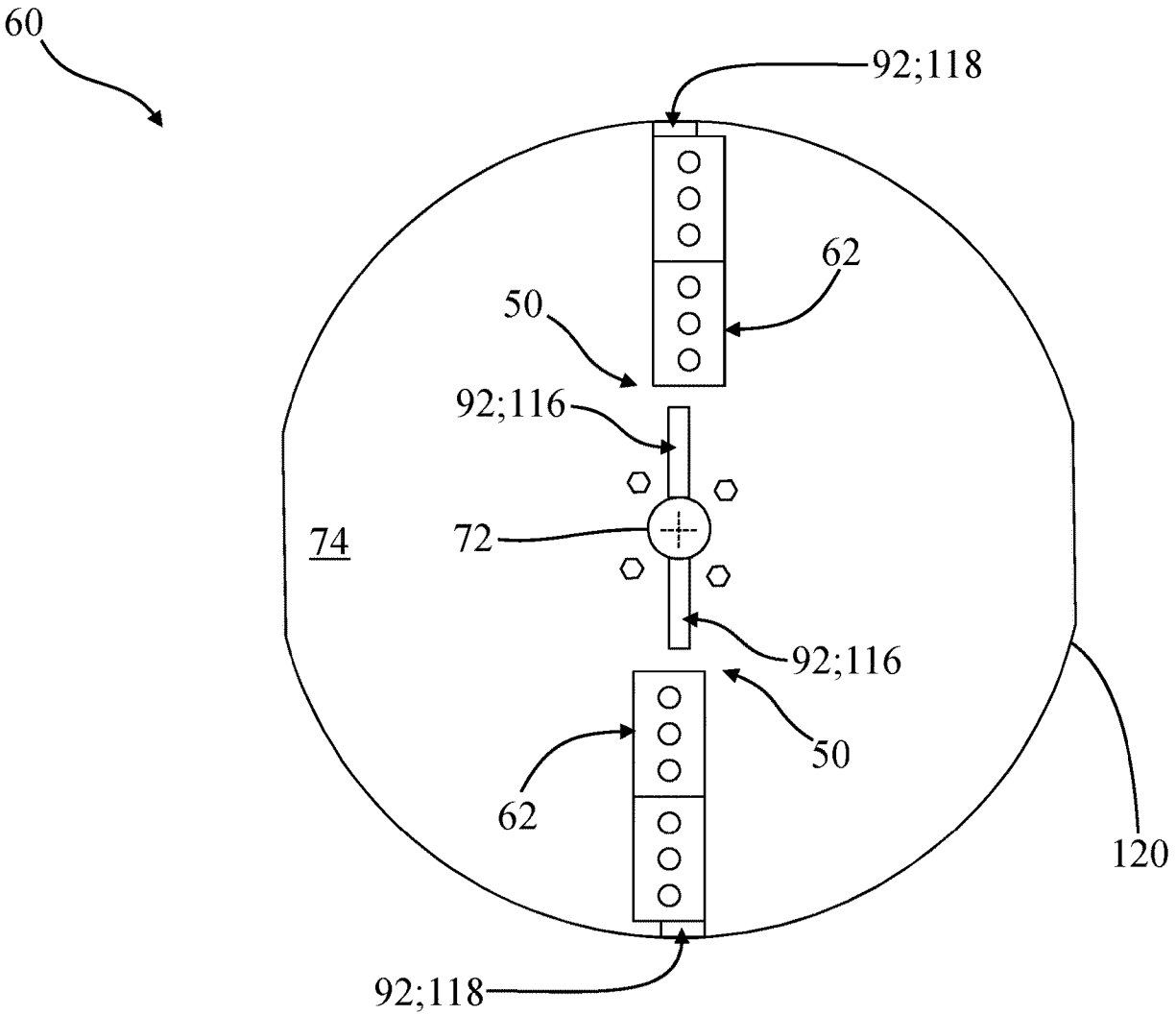
FIG. 16 is a front-side schematic illustration depicting another embodiment of a disc for use with the cutting assembly of FIGS. 4-6, shown having cutting members, inner shear blocks, and outer shear blocks.
Figure 17:
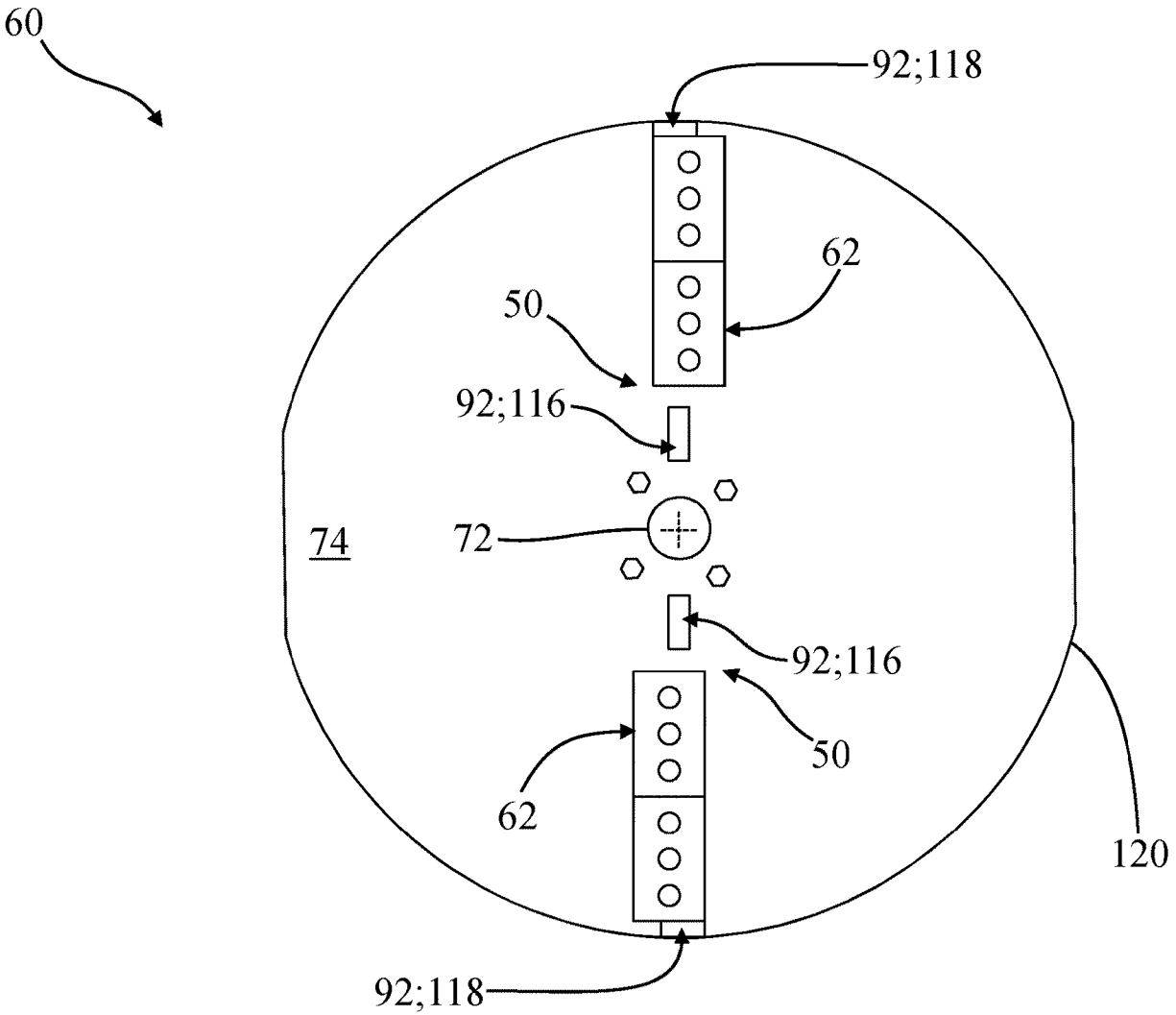
FIG. 17 is a front-side schematic illustration depicting another embodiment of a disc for use with the cutting assembly of FIGS. 4-6, shown having cutting members, inner shear blocks, and outer shear blocks.

In certain embodiments, such as those depicted in FIGS. 12 and 13, the line shear element 90 is configured to shear, cut, or otherwise break lines 84 as one of the cutting members 62 passes by the shear element 90 within the cutting chamber 66 of the housing 58. In certain embodiments, the safety device 50 further comprises one or more shear blocks, generally indicated at 92, which are fixed to the disc 60, are formed separately from the cutting members 62, and which extend away from the axial surface 74 to shear lines caught by the rotating disc 60 between the shear block 92 and the line shear element 90 (see FIG. 11E). In certain embodiments, one or more shear blocks 92 could also be arranged so as to shear lines caught by the rotating disc 60 between the shear block 92 and the cutting anvil 64. Thus, it will be appreciated that the advantages afforded by the safety device 50 of the present invention can be realized by cooperation between the line shear element 90 and the cutting member 62 to shear the line 48, and/or by cooperation between the line shear element 90 and the shear block 92 to shear the line 48. The line shear elements 90 and the shear blocks 92 will each be described in greater detail below.

Figure 7:
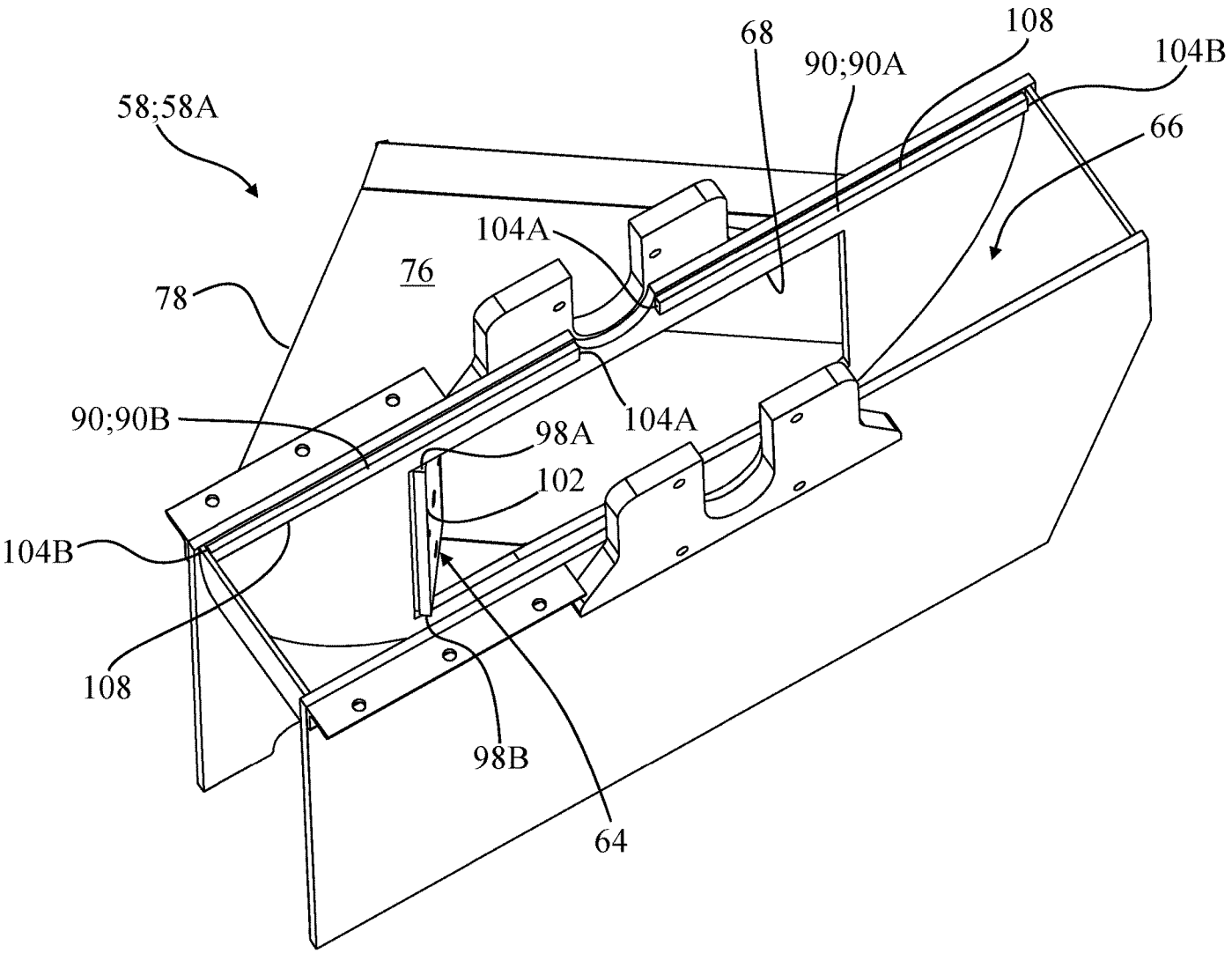
FIG. 7 is an angled perspective view of the lower housing component of FIGS. 4-6, depicting a pair of line shear elements disposed within the cutting chamber of the housing according to one embodiment of the present invention.
Figure 8:
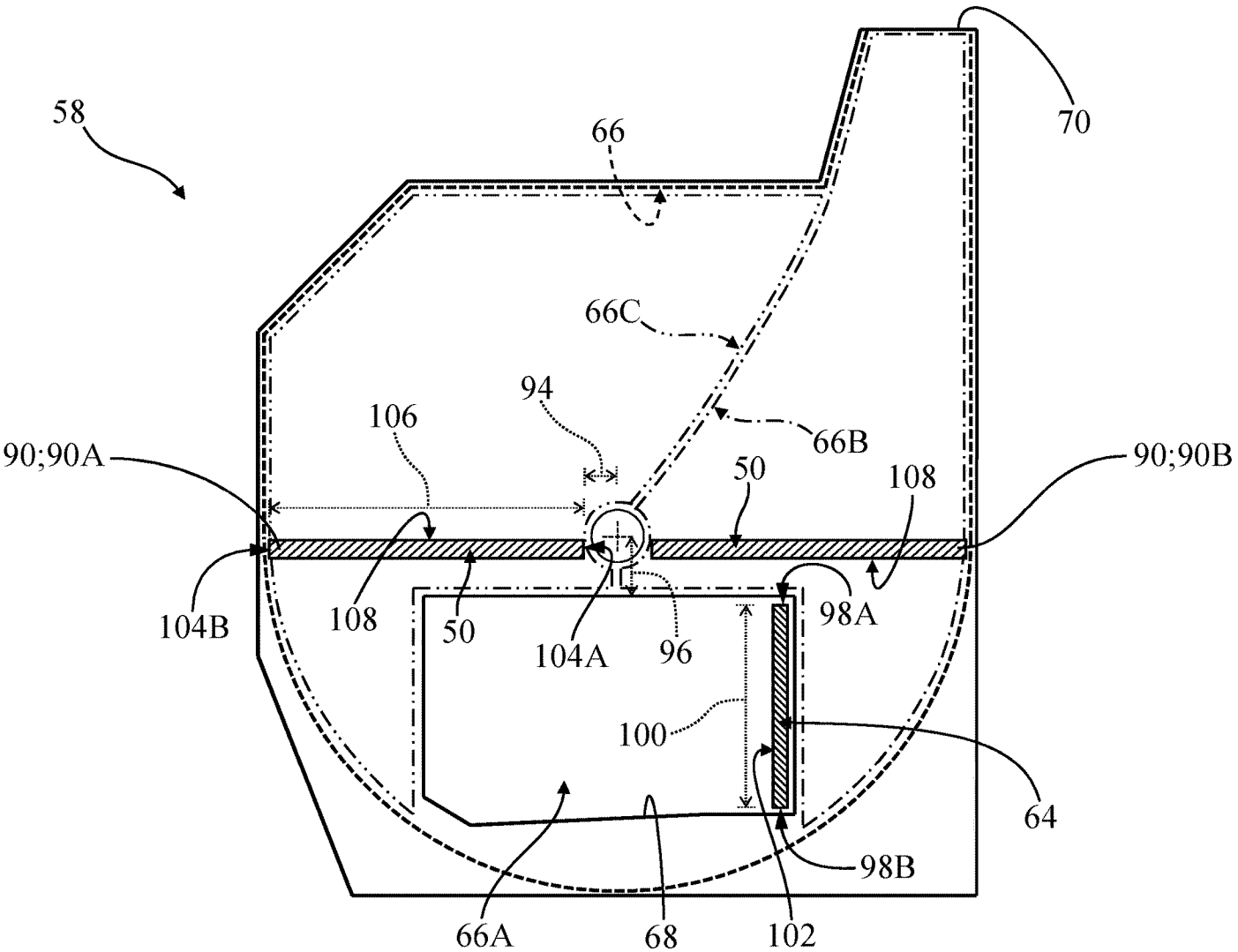
FIG. 8 is a front-side schematic illustration of the housing components, the cutting chamber, the intake opening, the cutting anvil, and the line shear elements of the housing depicted in FIGS. 4-7.

Referring now to FIGS. 7 and 8, in one embodiment, the line shear element 90 has a generally rectangular profile and is operatively attached to the lower housing component 58A of the housing 58, such as by welding (not shown). In the representative embodiment illustrated in FIGS. 4-8, the safety device 50 includes first and second line shear elements 90A, 90B which each extend into the cutting chamber 66 towards the axial surface 74 of the disc 60. Here, the first line shear element 90A and the second line shear element 90B are both spaced from the cutting anvil 64 and from each other within the cutting chamber 66. As shown best in FIG. 8, in one embodiment, the first line shear element 90A and the second line shear element 90B are each arranged generally transverse to the axis AX and are substantially parallel to each other.

Figure 18:
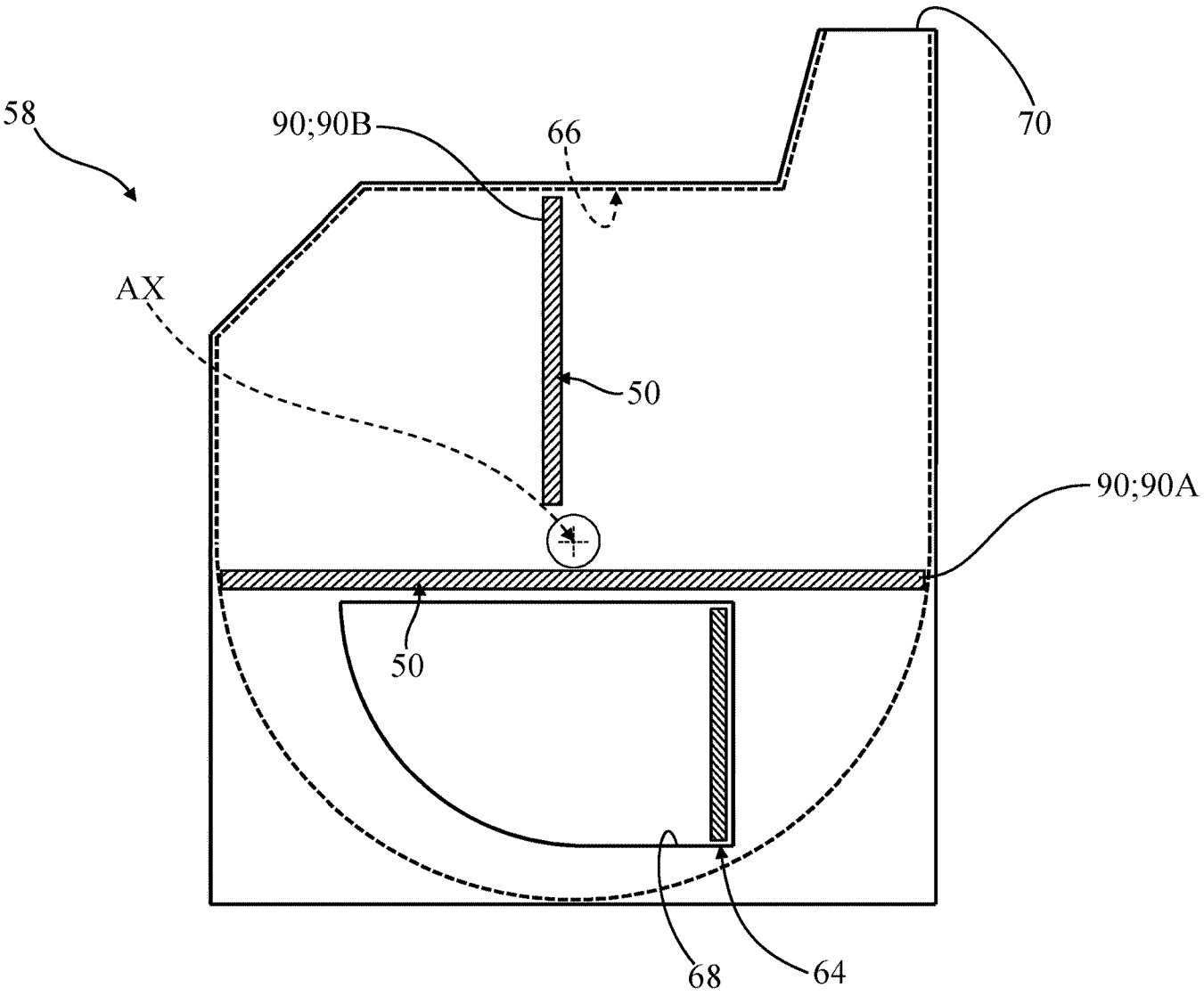
FIG. 18 is a front-side schematic illustration depicting another embodiment of a housing, cutting chamber, intake opening, and line shear elements for use with the cutting assembly of FIGS. 4-6.

As shown in FIG. 8, in one embodiment, a first radial distance 94 is defined between the axis AX and the line shear element 90, and a second radial distance 96, greater than the first radial distance 94, is defined between the axis AX and the intake opening 68 defined in the housing 58 (as noted above, the axis AX is depicted in FIG. 8 as a dash-dash cross without a leader or label for the purpose of clarity). Put differently, the line shear element 90 is arranged so as to be at least partially disposed closer to the axis AX than to the intake opening 68. However, other arrangements and configurations of the line shear element 90 are contemplated herein. By way of non-limiting example, another embodiment of the housing 58 is schematically depicted in FIG. 18 with a first line shear element 90A which extends perpendicularly to the cutting anvil 64, and with a second line shear element 90B which is arranged parallel to the cutting anvil 64. Here in this embodiment, the first line shear element 90A is longer than the second line shear element 90B and is arranged perpendicular to the second line shear element 90B. However, as noted above, any number of line shear elements 90 could be provided and could be shaped and/or arranged in any suitable way sufficient to shear lines 84 trapped by the rotating disc 60 without departing from the scope of the present invention.

As noted above, the line shear elements 90 are provided to shear, cut, or otherwise break the trapped line 48 as the disc 60 rotates and are not configured, positioned, or arranged so as to reduce waste materials as the cutting member 62 revolves about the axis AX. Referring to FIG. 8, in one embodiment, the cutting chamber 66 of the housing 56 comprises an intake zone 66A, a discharge zone 66B, and a dead zone 66C. The intake zone 66A is defined by the intake opening 68 for receiving waste material into the cutting chamber 66 to be reduced. The discharge zone 66B is defined between the intake zone 66A and the discharge opening 70 for expelling reduced waste material from the intake zone 66A out of the cutting chamber 66, such as via windage generated by the windage elements 82 described above in connection with FIG. 6. The dead zone 66C is defined between the discharge zone 66B and the intake zone 66A. As shown in FIG. 8, in the representative embodiment illustrated herein, the cutting anvil 64 is disposed in the intake zone 66A, the first line shear element 90A is disposed in the dead zone 66C, and the second line shear element 90B is disposed in the discharge zone 66B. However, as noted above, other arrangements of the line shear elements 90A, 90B are contemplated herein. By way of non-limiting example, a single line shear element 90 could be provided.

With continued reference to FIGS. 7 and 8, in one embodiment, the cutting anvil 64 has opposing first and second anvil sides 98A, 98B defining an anvil length 100 (see FIG. 8) with an anvil edge 102 extending between the anvil sides 98A, 98B along the anvil length 100. Similarly, the line shear element 90 has opposing first and second shear element sides 104A, 104B defining a shear element length 106 (see FIG. 8) with a shear element edge 108 extending between the shear element sides 104A, 104B along the shear element length 106. While the shear element length 106 is depicted in connection only with the first line shear element 90A in FIG. 8, those having ordinary skill in the art will appreciate that each line shear element 90 could have respective lengths with separate sides and edges.

As shown in FIG. 8, in one embodiment, the first anvil side 98A is arranged radially closer to the axis AX than the second anvil side 98B, the first shear element side 104A is arranged radially closer to the axis AX than the second shear element side 104B, and the first shear element side 104A is arranged radially closer to the axis AX than the first anvil side 98A. In one embodiment, the shear element length 106 of the line shear element 90 is greater than the anvil length 100 of the cutting anvil 64. In one embodiment, the shear element edge 108 of the line shear element 90 is arranged substantially normal to the axial surface 74 of the disc 60. In one embodiment, the shear element edge 108 of the line shear element 90 is arranged substantially perpendicular to the anvil edge 102 of the cutting anvil 64.

Figure 9:
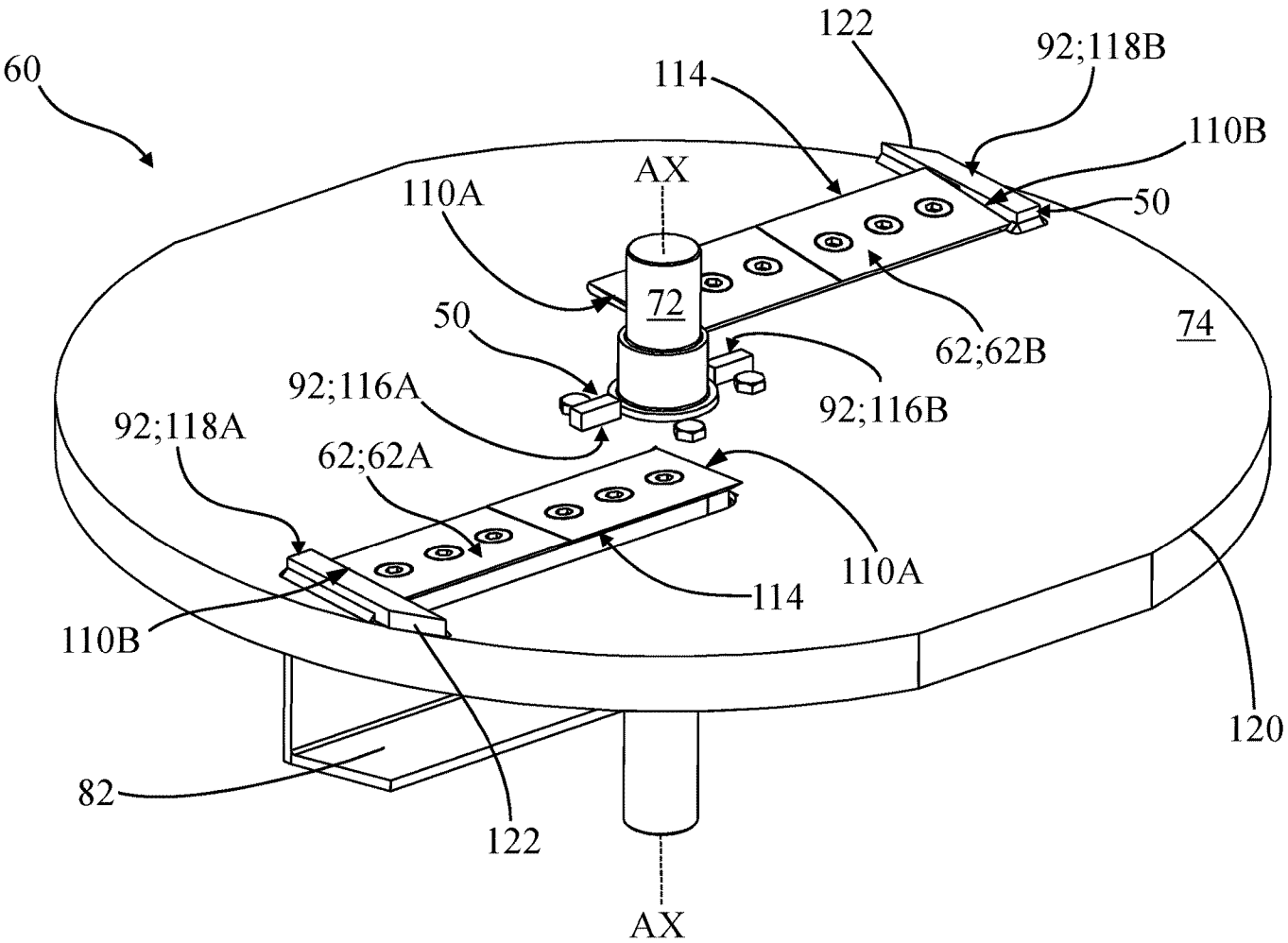
FIG. 9 is a perspective view of the disc of the cutting assembly of FIGS. 4-6, shown having a pair of cutting members, a pair of inner shear blocks, and a pair of outer shear blocks according to one embodiment.
Figure 10:
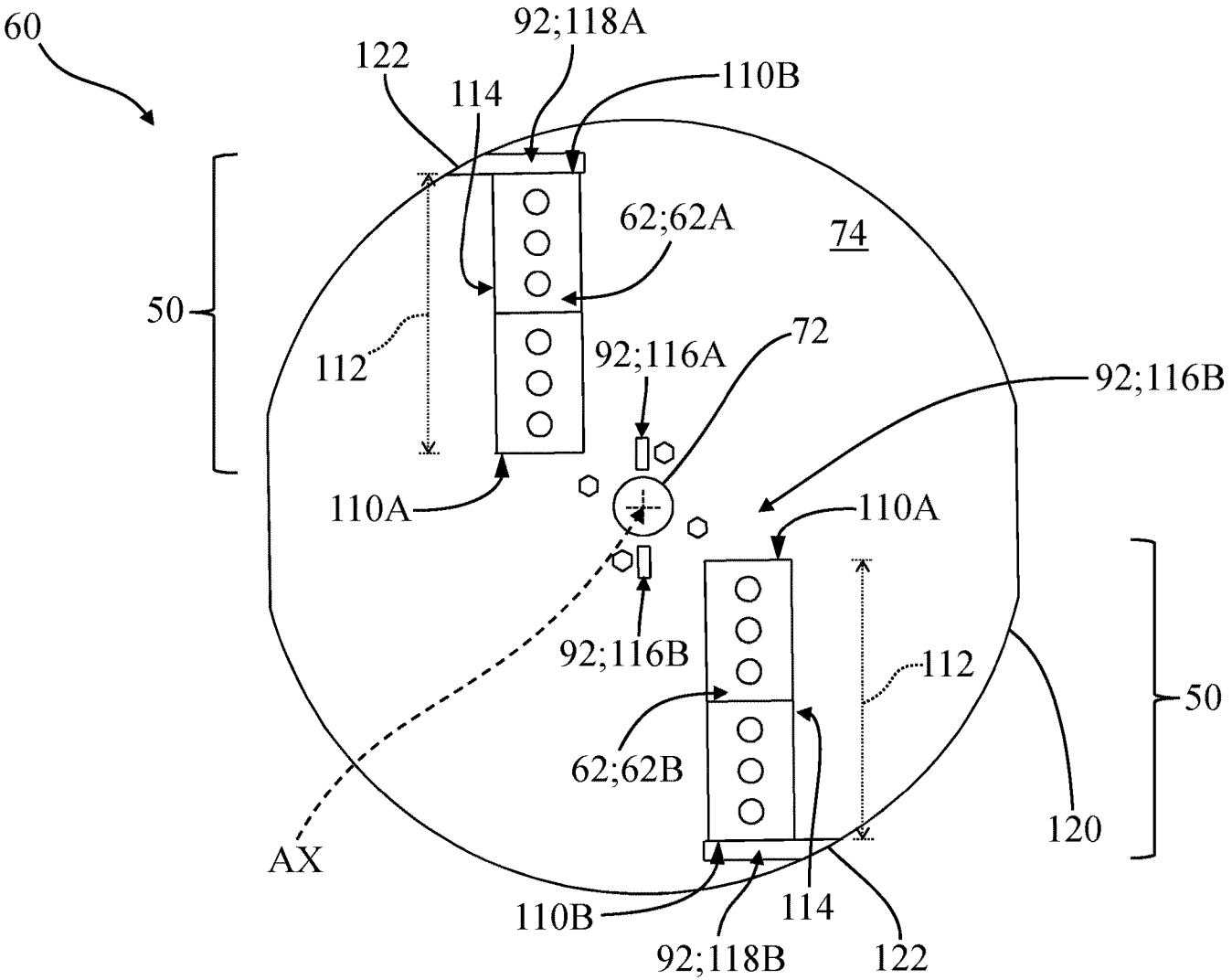
FIG. 10 is a front-side schematic illustration of the disc, the cutting members, the inner shear blocks, and the outer shear blocks of the disc depicted in FIG. 9

Referring now to FIGS. 9 and 10, in one embodiment, the cutting member 62 has opposing first and second cutting member sides 110A, 110B defining a cutting member length 112 (see FIG. 10) with a cutting member edge 114 extending between the cutting member sides 110A, 110B along the cutting member length 112. Here too, while the cutting member length 112 is depicted in connection only with the first cutting member 62A in FIG. 10, those having ordinary skill in the art will appreciate that each cutting member 62 could have respective lengths with separate sides and edges. In the representative embodiment illustrated in FIGS. 4-10, the shear element length 106 of the line shear element 90 (see FIG. 8) is greater than the cutting member length 112 of the cutting member 62 (see FIG. 10).

As noted above, in certain embodiments, the safety device 50 includes one or more shear blocks 92 fixed to the disc 60 and arranged so as to shear trapped lines 84 between the shear block 92 and the line shear element 90. Here, the shear blocks 92 may be realized as inner shear blocks 116 disposed between the cutting member 62 and the axis AX, or as outer shear blocks 118 disposed between the cutting member 62 and a disc periphery 120 defined by the axial surface 74 of the disc 60. Here too, both the inner shear blocks 116 and the outer shear blocks 118 are arranged to shear lines 84 trapped by the rotating disc 60: between the line shear element 90 and the inner shear blocks 116 (see FIG. 11E), and between the line shear element 90 and the outer shear blocks 118. Various arrangements of shear blocks 92 are illustrated throughout the drawings and are described in greater detail below, and it will be appreciated that different arrangements and configurations of inner shear blocks 116 and/or outer shear blocks 118 can be utilized for certain applications.

With continued reference to FIGS. 9 and 10, in one embodiment, the safety device 50 includes a first inner shear block 116A disposed between the first cutting member 62A and the axis AX, and a second inner shear block 116B disposed between the second cutting member 62B and the axis AX. Here, both of the inner shear blocks 116A, 116B are arranged so as to shear lines 84 trapped by the rotating disc 60 (see FIG. 11E).

As noted above, different arrangements of inner shear blocks 116 are contemplated herein. FIGS. 14-17 depict embodiments of inner shear blocks 116 and outer shear blocks 118 with generally rectangular profiles. In the embodiment illustrated in FIG. 14, the inner shear blocks 116 extend from the cutting members 62 towards and abutting the shaft 72. In the embodiment illustrated in FIG. 15, the inner shear blocks 116 extend from the cutting members 62 toward but spaced from the shaft 72. In the embodiment illustrated in FIG. 16, the inner shear blocks 116 extend from the shaft 72 toward but spaced from the cutting members 62. In the embodiment illustrated in FIG. 17, the inner shear blocks 116 are disposed between and spaced from both the inner shear blocks 116 and the shaft 72. As noted above, other inner shear block 116 profiles and arrangements are contemplated herein.

As shown in FIGS. 9 and 10, in one embodiment, the safety device includes a first outer shear block 118A disposed between the first cutting member 62A and the disc periphery 120, and a second outer shear block 118B disposed between the second cutting member 62B and the disc periphery 120. In the representative embodiment illustrated in FIGS. 9 and 10, the outer shear blocks 118 of the safety device 50 each have a generally rectangular profile with a flat or arc-shaped surface 122 disposed adjacent the disc periphery 120, and are likewise arranged so as to shear lines 84 trapped by the rotating disc 60. In the embodiments illustrated in FIGS. 14-17, the outer shear blocks 118 of the safety device 50 each have a generally rectangular profile, are disposed adjacent the disc periphery 120, and are likewise arranged so as to shear lines 84 trapped by the rotating disc 60. It will be appreciated that different arrangements, shapes, and configurations of inner shear blocks 116 and/or outer shear blocks 118 are contemplated herein.

Referring now to FIGS. 11A-11F, the disc 60 depicted in FIG. 10 is shown supported within the housing 58 depicted in FIG. 8. Here, these drawings cooperate to illustrate one way the safety device 50 of the present invention can shear lines 84 trapped by the rotating disc 60, and each drawing depicts successive rotation of the disc 60 as described below.

Figure 11A:
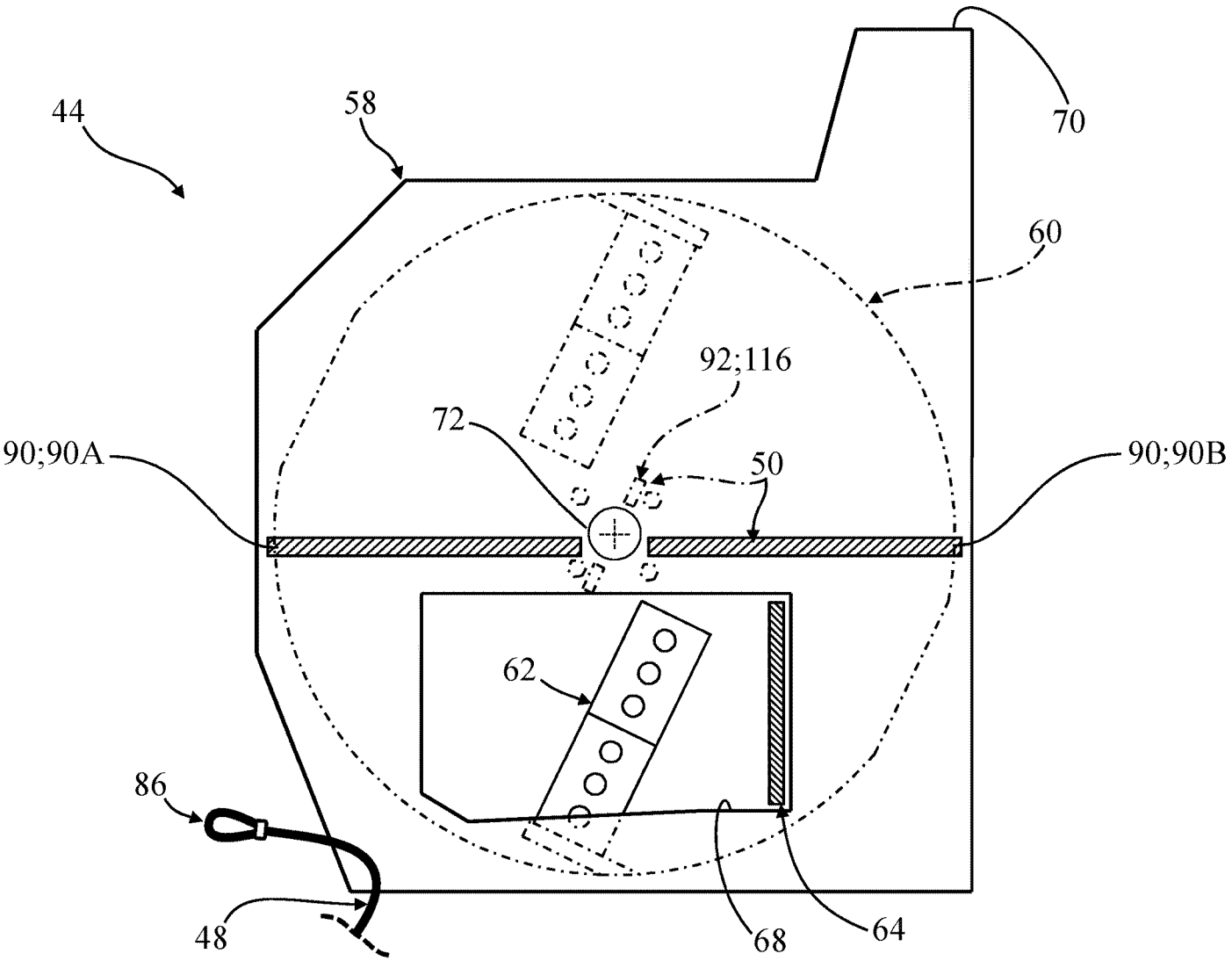
FIG. 11A is a first front-side schematic illustration of the disc depicted in FIG. 10 supported for rotation in the housing depicted in FIG. 8, showing a line with a line end positioned adjacent to the intake opening.
Figure 11B:
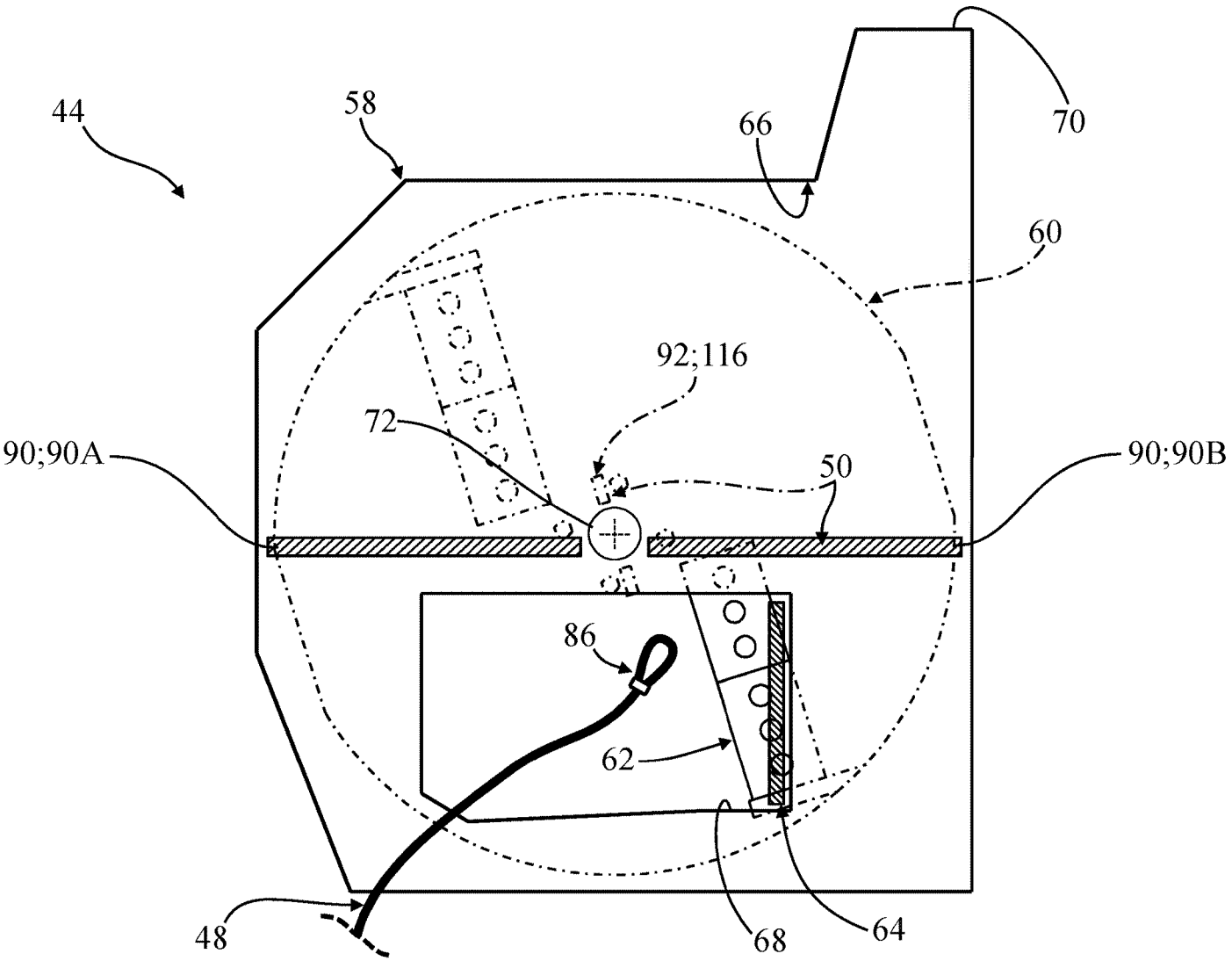
FIG. 11B is a second, consecutive front-side schematic illustration of the disc, the housing, the line, and the line end of FIG. 11A, showing the line end positioned in the intake opening.
Figure 11C:
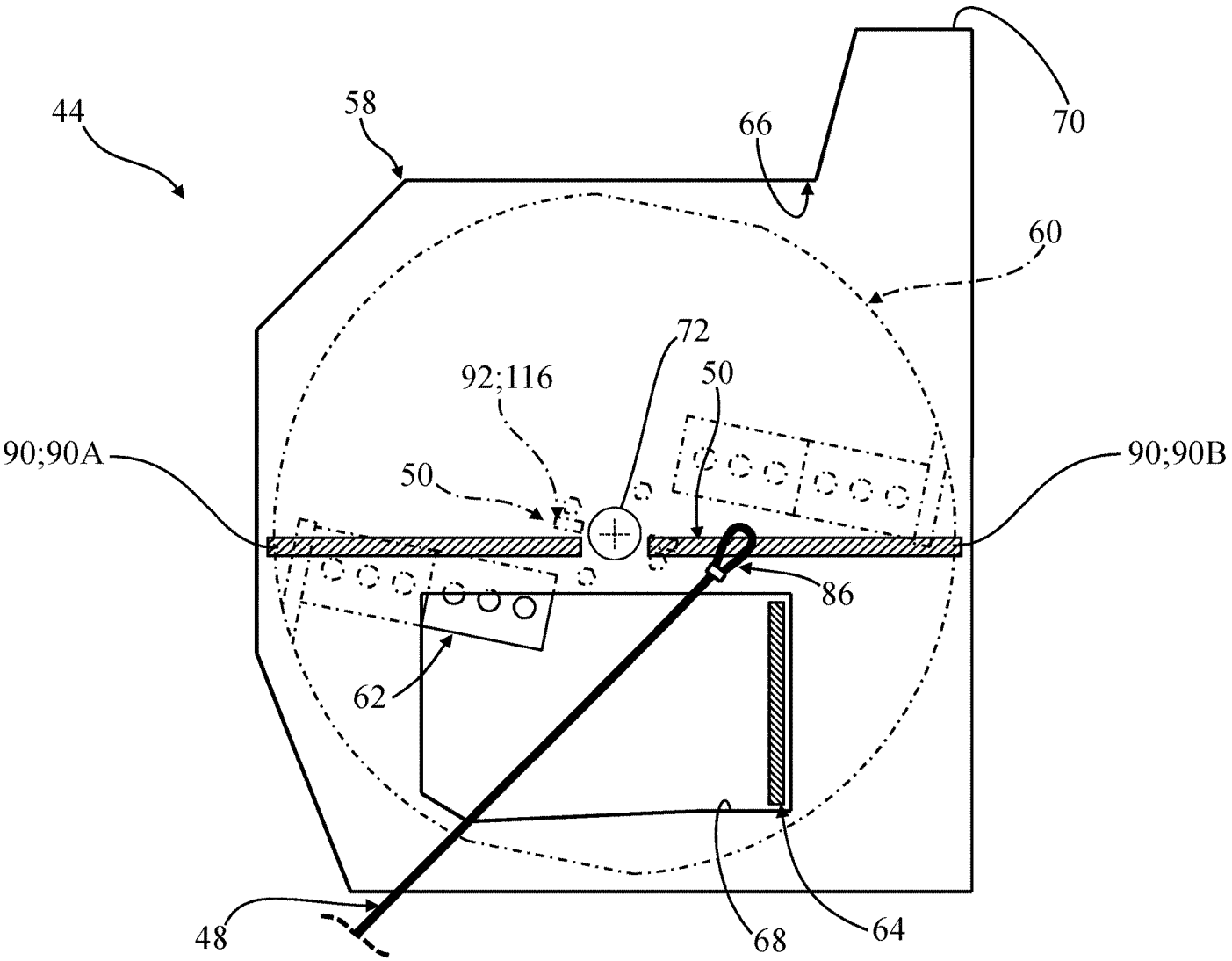
FIG. 11C is a third, consecutive front-side schematic illustration of the disc, the housing, the line, and the line end of FIGS. 11A-11B, showing the line end pulled into the cutting chamber by the rotating disc.
Figure 11D:
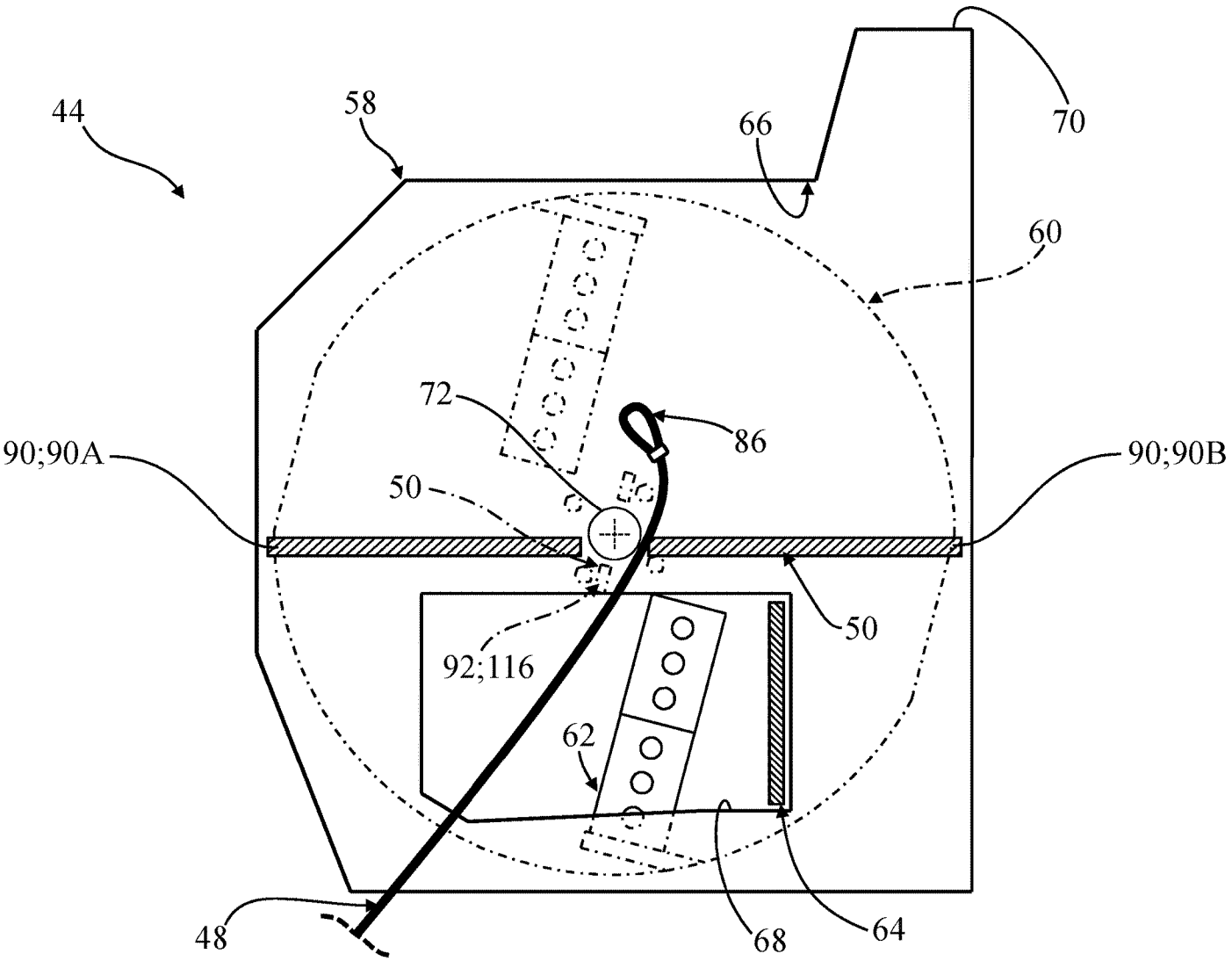
FIG. 11D is a fourth, consecutive front-side schematic illustration of the disc, the housing, the line, and the line end of FIGS. 11A-11C, showing the line end pulled further into the cutting chamber by the rotating disc.
Figure 11F:
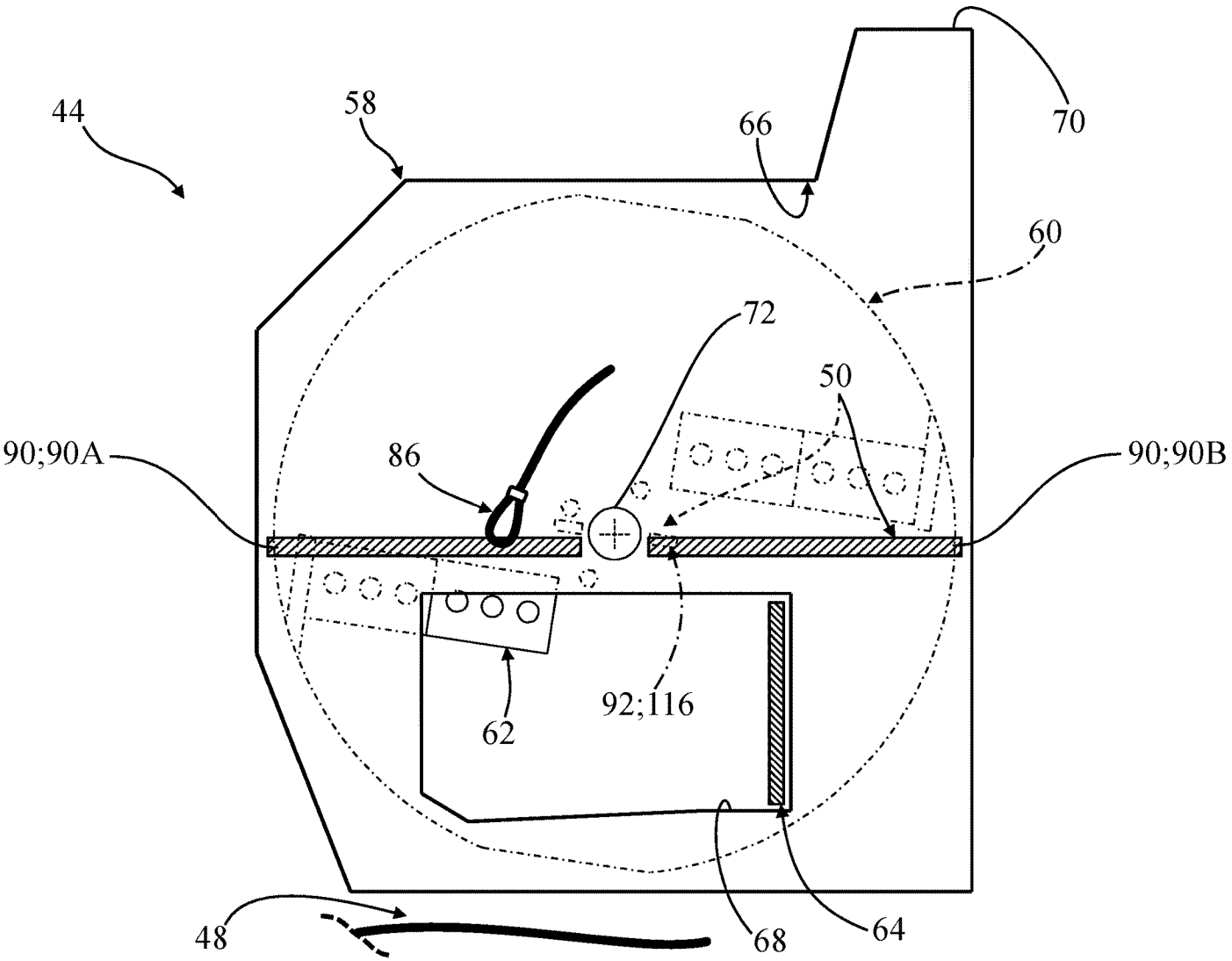
FIG. 11F is a sixth, consecutive front-side schematic illustration of the disc, the housing, the line, and the line end of FIGS. 11A-11E, showing the line end and a portion of the line cut off from the rest of the line outside the housing.

FIG. 11A shows the line end 86 of the line 48 positioned adjacent to the intake opening 68 formed in the housing 58. In FIG. 11B the line end 86 of the line 48 has entered the intake opening 68 and has engaged the rotating disc 60 (compare FIG. 11B with FIG. 11A). In FIG. 11C, continued rotation of the disc 60 has trapped the line end 86 and has begun to pull the line 48 into the cutting chamber 66 of the housing 58 as the line end 86 approaches one of the line shear elements 90 of the safety device 50 (compare FIG. 11C with FIG. 11B). Here, because the line end 86 was trapped by the disc 60 between the cutting members 60, no part of the line 48 has passed by the cutting anvil 64. In FIG. 11D, rotation of the disc 60 continues to pull the trapped line 48 into the cutting chamber 66 of the housing 58, and a portion of the line 48 spaced from the line end 86 has traversed one of the line shear elements 90 of the safety device 50 as the line 48 begins to wrap around the shaft 72 (compare FIG. 11D with FIG. 11C). In FIG. 11E, while rotation of the disc 60 has continued to pull the trapped line 48 further into the cutting chamber 66 of the housing, one of the inner shear blocks 116 has come into alignment with the portion of the line 48 traversing the line shear element 90 at a shear point SP (compare FIG. 11E with FIG. 11D). Here, the line 48 is sheared, cut, or otherwise broken at the shear point SP. In FIG. 11F, the line end 86 and a portion of the sheared line 48 remains trapped within the cutting chamber 66 of the housing 58, but the rest of the line 48 is no longer trapped by the rotating disc 60 and, thus, is no longer being retracted into the cutting chamber 66 (compare FIG. 11F with FIG. 11E).

As noted above, the safety device 50 can shear the trapped line 48 against the line shear element 90 in different ways. In FIG. 11E, the shear point SP is arranged between the second line shear element 90B and one of the inner shear blocks 116. In FIG. 12, the shear point SP is arranged between the second line shear element 90B and one of the cutting members 62. In FIG. 13, the shear point SP is arranged between the first line shear element 90A and one of the cutting members 62.

In this way, the safety device 50 of the present invention significantly reduces potential retraction of lines 48 in connection with disc-chipper type waste processing machines 30 by promoting cutting, shearing, or otherwise breaking of lines 84, cables, and/or ropes inadvertently captured by the rotating disc 60 that might otherwise pull objects towards the waste processing machine 30. Specifically, those having ordinary skill in the art will appreciate that trapped lines 84 can be sheared via the line 48 traversing one of the line shear elements 90 as either one of the cutting members 62 or one of the shear blocks 92 revolves into alignment with the line shear element 90 at the shear point SP. Thus, the safety device 50 of the present invention allows the inadvertently trapped line 48 to be sheared quickly and without excessive retraction into the cutting chamber 66. Moreover, the safety device 50 affords opportunities for shearing trapped lines 84 which are pulled towards the shaft 72 that might otherwise retract significantly into the cutting chamber 66 before coming into alignment between the cutting anvil 64 and the cutting member 62. Thus, physical injuries to operators and other bystanders, as well as damage to the waste processing machine 30 and other property, may be averted.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

What is claimed is:

1. A waste processing machine for reducing waste material and having a safety device for shearing lines, comprising:

a housing defining a cutting chamber and an intake opening in communication with said cutting chamber for receiving waste material;

a disc disposed in said cutting chamber and supported for rotation about an axis, said disc having an axial surface facing said intake opening;

a cutting member fixed to said disc for revolution about said axis concurrent with rotation of said disc for reducing waste material;

a cutting anvil coupled to said housing adjacent said intake opening, and arranged facing said axial surface of said disc for reducing waste material between said cutting anvil and said cutting member as said cutting member revolves about said axis toward said cutting anvil; and a line shear element operatively attached to said housing and extending into said cutting chamber toward said axial surface of said disc, and spaced from said cutting anvil for shearing lines caught by said rotating disc.

2. The waste processing machine as set forth in claim 1, wherein said cutting anvil has opposing first and second anvil sides defining an anvil length with an anvil edge extending between said anvil sides along said anvil length;

wherein said line shear element has opposing first and second shear element sides defining a shear element length with a shear element edge extending between said shear element sides along said shear element length; and wherein said shear element length of said line shear element is greater than said anvil length of said cutting anvil.

3. The waste processing machine as set forth in claim 1, wherein said line shear element has opposing first and second shear element sides defining a shear element length with a shear element edge extending between said shear element sides along said shear element length; and wherein said shear element edge of said line shear element is arranged substantially normal to said axial surface of said disc.

4. The waste processing machine as set forth in claim 1, wherein said cutting anvil has opposing first and second anvil sides defining an anvil length with an anvil edge extending between said anvil sides along said anvil length;

wherein said line shear element has opposing first and second shear element sides defining a shear element length with a shear element edge extending between said shear element sides along said shear element length; and wherein said shear element edge of said line shear element is arranged substantially perpendicular to said anvil edge of said cutting anvil.

5. The waste processing machine as set forth in claim 1, wherein said cutting anvil has opposing first and second anvil sides defining an anvil length with an anvil edge extending between said anvil sides along said anvil length;

wherein said line shear element has opposing first and second shear element sides defining a shear element length with a shear element edge extending between said shear element sides along said shear element length; and wherein said first anvil side is arranged radially closer to said axis than said second anvil side, said first shear element side is arranged radially closer to said axis than said second shear element side, and said first shear element side is arranged radially closer to said axis than said first anvil side.

6. The waste processing machine as set forth in claim 1, wherein said cutting member has opposing first and second cutting member sides defining a cutting member length with a cutting member edge extending between said cutting member sides along said cutting member length;

wherein said line shear element has opposing first and second shear element sides defining a shear element length with a shear element edge extending between said shear element sides along said shear element length; and wherein said shear element length of said line shear element is greater than said cutting member length of said cutting member.

7. The waste processing machine as set forth in claim 1, wherein a first radial distance is defined between said axis and said line shear element; and wherein a second radial distance, greater than said first radial distance, is defined between said axis and said intake opening defined in said housing.

8. The waste processing machine as set forth in claim 1, further comprising an inner shear block fixed to said disc, disposed between said cutting member and said axis, and extending away from said axial surface of said disc to shear lines caught by said rotating disc between said inner shear block and at least one of said cutting anvil and said line shear element.

9. The waste processing machine as set forth in claim 8, wherein said inner shear block has a generally rectangular profile.

10. The waste processing machine as set forth in claim 8, wherein said cutting member is further defined as a first cutting member;

further comprising a second cutting member spaced from said first cutting member and fixed to said disc for revolution about said axis concurrent with rotation of said disc for reducing waste material; and wherein said inner shear block is disposed between said first cutting member and said second cutting member.

11. The waste processing machine as set forth in claim 10, wherein said inner shear block is further defined as a first inner shear block disposed between said first cutting member and said axis; and further comprising a second inner shear block fixed to said disc, disposed between said second cutting member and said axis, and extending away from said axial surface of said disc to shear lines caught by said rotating disc between said second inner shear block and at least one of said cutting anvil and said line shear element.

12. The waste processing machine as set forth in claim 1, wherein said axial surface of said disc defines a disc periphery; and further comprising an outer shear block fixed to said disc, disposed between said cutting member and said disc periphery, and extending away from said axial surface of said disc to shear lines caught by said rotating disc between said outer shear block and said line shear element.

13. The waste processing machine as set forth in claim 12, wherein said outer shear block has a generally rectangular profile.

14. The waste processing machine as set forth in claim 12, wherein said outer shear block has a profile defined by at least one arc-shaped surface.

15. The waste processing machine as set forth in claim 12, wherein said cutting member is further defined as a first cutting member;

further comprising a second cutting member spaced from said first cutting member and fixed to said disc for revolution about said axis concurrent with rotation of said disc for reducing waste material;

wherein said outer shear block is further defined as a first outer shear block disposed between said first cutting member and said disc periphery; and further comprising a second outer shear block fixed to said disc, disposed between said second cutting member and said disc periphery, and extending away from said axial surface of said disc to shear lines caught by said rotating disc between said second outer shear block and said line shear element.

16. The waste processing machine as set forth in claim 1, wherein said line shear element has a generally rectangular profile.

17. The waste processing machine as set forth in claim 1, wherein said line shear element is further defined as a first line shear element; and further comprising a second line shear element extending into said cutting chamber toward said axial surface of said disc and spaced from said cutting anvil and from said first line shear element to shear lines caught by said rotating disc.

18. The waste processing machine as set forth in claim 17, wherein said first line shear element and said second line shear element are each arranged generally transverse to said axis.

19. The waste processing machine as set forth in claim 18, wherein said first line shear element and said second line shear element are parallel to each other.

20. The waste processing machine as set forth in claim 1, wherein said housing further defines a discharge opening in communication with said cutting chamber for expelling waste material reduced between said cutting anvil and said cutting member as said cutting member revolves about said axis toward said cutting anvil;

wherein said cutting chamber of said housing comprises:

an intake zone defined by said intake opening for receiving waste material into said cutting chamber to be reduced, a discharge zone defined between said intake zone and said discharge opening for expelling reduced waste material from said intake zone out of said cutting chamber, and a dead zone defined between said discharge zone and said intake zone; and wherein said line shear element is disposed in said dead zone.

21. The waste processing machine as set forth in claim 20, wherein said cutting anvil is disposed in said intake zone.

22. The waste processing machine as set forth in claim 20, wherein said line shear element is further defined as a first line shear element disposed in said dead zone;

further comprising a second line shear element extending into said cutting chamber toward said axial surface of said disc and spaced from said cutting anvil and from said first line shear element to shear lines caught by said rotating disc; and wherein said second line shear element is disposed in said discharge zone.

* * * * *